US008596629B2

(12) United States Patent
Hancock et al.

(10) Patent No.: US 8,596,629 B2
(45) Date of Patent: Dec. 3, 2013

(54) ADAPTIVE REGISTRATION/BINDING APPARATUS FOR PREPARING COLLATIONS

(75) Inventors: Mark S Hancock, Gaylordsville, CT (US); Robert F Marcinik, Wallkill, NY (US)

(73) Assignee: Pitney Bowes Inc., Stamford, CT (US)

( * ) Notice: Subject to any disclaimer, the term of this patent is extended or adjusted under 35 U.S.C. 154(b) by 62 days.

(21) Appl. No.: 13/288,101

(22) Filed: Nov. 3, 2011

(65) Prior Publication Data

US 2013/0113152 A1 May 9, 2013

(51) Int. Cl.

| | |
|---|---|
| ***B65H 37/04*** | (2006.01) |
| ***B65H 37/06*** | (2006.01) |
| ***B65H 9/10*** | (2006.01) |

(52) U.S. Cl.

USPC ..... 270/37; 270/32; 270/58.27; 270/58.12; 270/58.17; 270/52.18; 271/226; 271/234

(58) Field of Classification Search

USPC ..... 270/32, 37, 52.16, 52.18, 45, 58.29, 270/58.27, 58.12, 58.17; 271/233, 234, 271/243, 244, 253, 221

See application file for complete search history.

(56) References Cited

U.S. PATENT DOCUMENTS

| | | | | |
|---|---|---|---|---|
| 4,891,681 | A * | 1/1990 | Fiske et al. | 399/385 |
| 5,013,200 | A * | 5/1991 | Hunder et al. | 412/6 |
| 5,149,076 | A * | 9/1992 | Stenz | 271/2 |
| 5,657,615 | A * | 8/1997 | Muller | 53/448 |
| 6,730,870 | B1 * | 5/2004 | Werner | 209/584 |
| 7,942,399 | B2 * | 5/2011 | Hirai et al. | 270/58.07 |
| 7,984,897 | B2 | 7/2011 | Williams | |
| 8,061,505 | B2 * | 11/2011 | Honegger et al. | 198/419.3 |
| 8,118,295 | B2 | 2/2012 | Marcinik | |
| 8,306,654 | B2 | 11/2012 | Marcinik | |
| 8,366,092 | B2 * | 2/2013 | Kwarta et al. | 270/21.1 |
| 2010/0078292 | A1 * | 4/2010 | Honegger et al. | 198/431 |
| 2010/0148417 | A1 * | 6/2010 | Suzuki et al. | 270/58.12 |

* cited by examiner

*Primary Examiner* — Leslie A Nicholson, III

(74) *Attorney, Agent, or Firm* — Steven J. Shapiro; Charles R. Malandra, Jr.

(57) ABSTRACT

An apparatus for preparing a collation of sheets for folding operations. The system includes a registration device including multiple registration stations and a conveyance device for transporting the collation to one of the registration stations. Each registration station is adapted to register the edges of the collation based upon a desired edge geometry. A processor determines the fold configuration of the collation and determines the edge geometry thereof based upon the fold configuration of the collation. The processor selects one of the registration stations based upon the fold configuration and then controls the conveyance device to transport the collation to the selected registration station. The registration station selected may also be based upon the thickness of the collation and a desired location for binding the collation.

6 Claims, 18 Drawing Sheets

FIG. 1a
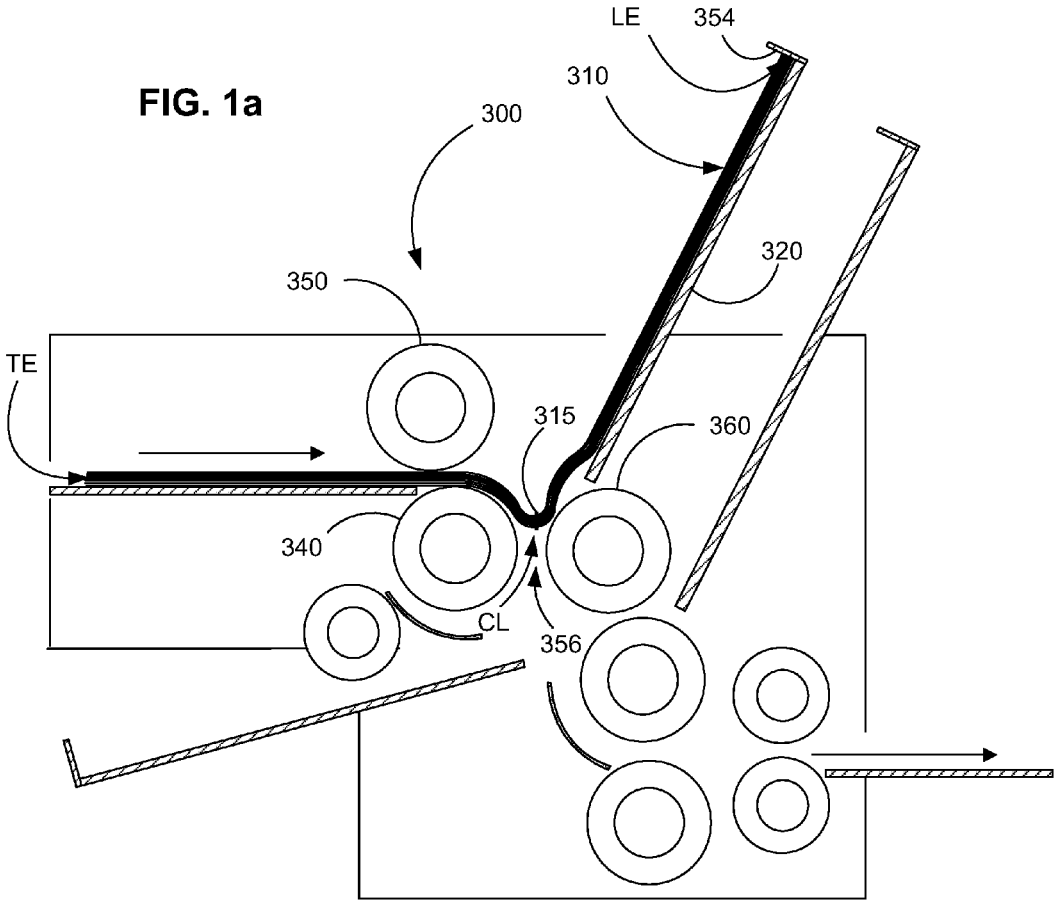
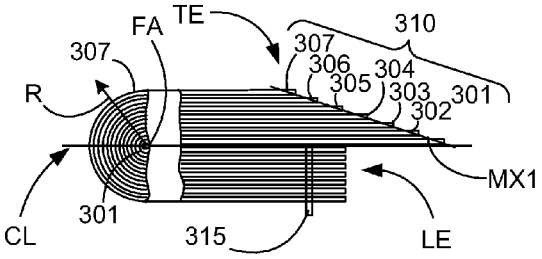
FIG. 1b
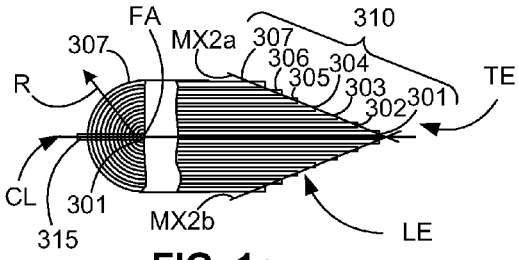
FIG. 1c

ADAPTIVE REGISTRATION/BINDING APPARATUS FOR PREPARING COLLATIONS

FIELD OF THE INVENTION

The present invention relates to apparatus for preparing stacked sheets of material, and more particularly, to an adaptive registration/binding apparatus which prepares collations having a variety of fold configurations and integrates the registration/binding operations.

BACKGROUND OF THE INVENTION

Various apparatus are employed for arranging sheet material in a package suitable for use or sale in commerce. One such apparatus, useful for describing the teachings of the present invention, is a mail piece inserter system employed in the fabrication of high volume mail communications, e.g., mass mailings. Such mailpiece inserter systems are typically used by organizations such as banks, insurance companies and utility companies for producing a large volume of specific mail communications where the contents of each mailpiece are directed to a particular addressee. Also, other organizations, such as direct mailers, use mailpiece inserters for producing mass mailings where the contents of each mail piece are substantially identical with respect to each addressee. Examples of inserter systems are the 8 series, 9 series, and APS™ inserter systems available from Pitney Bowes Inc. located in Stamford, Conn., USA.

In many respects, a typical inserter system resembles a manufacturing assembly line. Sheets and other raw materials (i.e., a web of paper stock, enclosures, and envelopes) enter the mailpiece inserter as inputs. Various modules or workstations in the mailpiece inserter work cooperatively to process the sheets until a finished mail piece is produced. The precise configuration of each inserter system depends upon the needs of each customer or installation.

Typically, mailpiece inserters prepare mail pieces by arranging preprinted sheets of material into a collation, i.e., the content material of the mail piece, on a transport deck. A typical collation may be created by stacking sheet material on the deck of a sheet accumulator which receives individual sheets from a pre-printed roll or web of sheet material. The roll dispenses a continuous stream of sheet material which is cut to size by a rotating guillotine cutter. Alternatively, pre-cut sheet material which is pre-printed may be stacked in a sheet feeder where a feeding device singulates individual sheets from the stack, i.e., typically the lowermost sheet of the stack.

From the accumulator, the collation of preprinted sheets may continue to a chassis module where additional sheets or inserts may be added to a targeted audience of mail piece recipients. From the chassis module the fully developed collation may continue to a stitcher module where the sheet material may be stitched, stapled or otherwise bound. While the stitched collation may be suitable for insertion directly into a mailpiece envelope, i.e., an envelope which is slightly oversized relative to the stitched collation, it is common for the collation to be folded to reduce the size of the envelope/mailpiece. Common fold arrangements include: bi-fold, tri-fold, Z-fold and gate fold configurations.

The bound/folded collation may then placed into a mailpiece envelope and conveyed to yet other stations for further processing. That is, collation may be inserted into an envelope, closed, sealed, weighed, printed, sorted and stacked. Alternatively, the folded collation may be closed by a tabbing device which places an adhesive tab around the free edges of the collation. Such tabbing devices eliminate the requirement for a mailpiece envelope inasmuch as the folded/tabbed collation is suitably bound for delivery. Additionally, a mailpiece inserter may include a module, i.e., a postage meter, for applying postage indicia based upon the weight and/or size of the mail piece.

While the principal measure of inserter performance is the number of mailpieces produced per unit time, i.e., the throughput of the inserter, a mailpiece inserter must also produce aesthetically pleasing mailpieces. With respect to the aesthetic appeal of a mailpiece, it will be appreciated that the appearance and condition of a mailpiece may be the first, and only, opportunity to offer/present a product or service to a prospective customer/client. A mailpiece having content material which is poorly fabricated, i.e., a collation which is misaligned, skewed or shingled, may inadvertently communicate a message that the product or service being advertised is, similarly, poor/low quality. Conversely, a high quality mailpiece, i.e., one having sharp lines with aligned edges, may communicate a message that the product being offered has a similar level of quality. Upon receipt of such mailpiece, a prospective customer/client may subconsciously think "a company which puts such thought/effort into its mailpiece must produce a high quality product/offer top-notch service".

While contemporary mailpiece inserters, such as the Flowmaster® Inserter produced by Pitney Bowes Inc. located in Stamford, Conn., produce high quality mailpieces, multi-sheet collations, i.e., having a thickness greater than about ten sheets, can present difficulties, especially when stitched/bound and folded. More specifically, as the thickness of a collation increases, it will be appreciated that folding about a fold line can result in skewing wherein the edges thereof are stepped/staggered.

FIGS. 1*a*-1*c* schematically depict a typical folding apparatus 300 (FIG. 1*a*), and enlarged views of the relevant details of folded multi-sheet collations 310*a*, 310*b* (FIGS. 1*b* and 1*c*). In FIG. 1, a collation 310 of sheet material is received by the folding apparatus 300 from an upstream stitcher (not shown) where the collation 310 is bound by staples 315 at a centerline CL of the collation 310 and passed upwardly along an inclined tray 320 of the folding apparatus 300 by a pair of nip rollers, i.e., first and second nip rollers 340, 350. As the collation 310 is driven up the tray 320, the leading edge LE of the collation 310 contacts a stop or abutment surface 354 disposed at the uppermost end of the tray 320. Upon engaging the abutment surface 354, the collation 310 bends downwardly along its centerline CL, i.e., towards a fold nip 356, defined by and between a third roller 360 and the first roller 340. As the nip rollers 340, 350 continue to drive the trailing edge TE of the collation 310, the collation 310 is captured by the fold nip 356 to fold the collation 300 along the centerline CL.

By examining FIGS. 1*b* and 1*c*, it will be appreciated at least one of the edges forms a stepped/staggered configuration as a result of folding the multi-sheet collation about a fold axis FA. In the context used herein, the term "fold axis" is defined as the virtual axis about which the innermost sheet 300 folds upon itself. It will be appreciated that sheets 301-307 are disposed radially outboard of the fold axis FA and fold around the fold axis FA. Furthermore, sheets 301-307 which are progressively farther outboard of the axis FA, i.e., along arrow R, result in the trailing edge TE of the collation 310 being stepped/staggered so as to define a slope or inclined plane MX1, MX2*a*, MX2*b*. Depending upon the location of the staple 315 and the alignment of the leading edge prior to binding, the collation 310 may develop a long shallow slope MX1, along the trailing edge TE (as shown in FIG. 1*b*) or sloped edges MX2*a*, MX2*b* along both leading and trailing edges LE, TE of the collation 310 (as shown in FIG. 1*c*).

While the lack of edge registration can typically be tolerated for thin collations, e.g., collations having two (2) or three (3) sheets, such poor edge registration is more problematic for larger, thicker collations, e.g., collations having seven (7) or more sheets. That is, as collations increase in thickness, the fold exacerbates the misalignment. If a "cleaner", more exacting, folded collation is required, then subsequent trimming/cutting operations are required to align the edges, i.e., effect a perpendicular alignment of the collective edges. It will be appreciated, however, that such additional trimming operations introduce additional registration and cutting apparatus which are costly to implement and maintain.

A need, therefore, exists for an apparatus for preparing collations suitable for folding operations. The apparatus prepares collations for folding without the requirement for additional trimming operations and performs multiple operations within a minimal space envelope.

SUMMARY OF THE INVENTION

An apparatus is provided for preparing a collation of sheets for folding operations. The system includes a registration device including multiple registration stations and a conveyance device for transporting the collation to one of the registration stations. Each registration station is adapted to register the edges of the collation based upon a desired edge geometry. A processor determines the fold configuration of the collation and determines the edge geometry thereof based upon the fold configuration of the collation. The processor selects one of the registration stations based upon the fold configuration and then controls the conveyance device to transport the collation to the selected registration station. The registration station selected may also be based upon the thickness of the collation and a desired location for binding the collation.

BRIEF DESCRIPTION OF THE DRAWINGS

Further details of the present invention are provided in the accompanying drawings, detailed description, and claims.

FIG. 1*a* depicts a schematic view of a folding apparatus commonly employed in a mailpiece inserter system.

FIGS. 1*b* and 1*c* are broken away edge views of a folded multi-sheet collation wherein the fold operation effects skewing/distortion of the trailing and/or leading edges of the collation.

DETAILED DESCRIPTION

The following detailed description discusses various systems/devices/modules of a mailpiece inserter for processing sheet material collations. One embodiment of the invention relates to a stitcher/stapler for binding multi-sheet collations and method for controlling the same. Another embodiment relates to a transport and alignment system for producing variable thickness collations. Yet another embodiment relates to an adjustable stitcher for binding consecutive variable thickness collations. Still another embodiment relates to preparing a multi-sheet collation for a folding operation. Still yet another embodiment relates to a system for selectively conveying a collation to one of several registration/binding stations within a multi-station registration/binding device. In this embodiment, the collation is prepared and conveyed to a registration station and/or a binding station based upon the fold configuration and/or thickness of the collation.

This invention described herein is directed to the embodiment described in the section entitled "Adaptive Registration/Binging Apparatus for Preparing Collations" and will be described in terms of a mailpiece inserter. While the inventions may be particularly useful for processing/producing mail communications, it should be appreciated that the inventions are broadly applicable to any apparatus/system which requires binding, transport and alignment of stacked sheets of material, i.e., a multi-sheet collation. As used herein, the term "collation" is any multi-sheet stack of material, i.e., having at least two (2) sheets, such as that required for fabricating, books, pamphlets, mailpiece content material etc.

Stitcher/Stapler for Binding Multi-sheet Collation and Method of Operation

Figure 2:
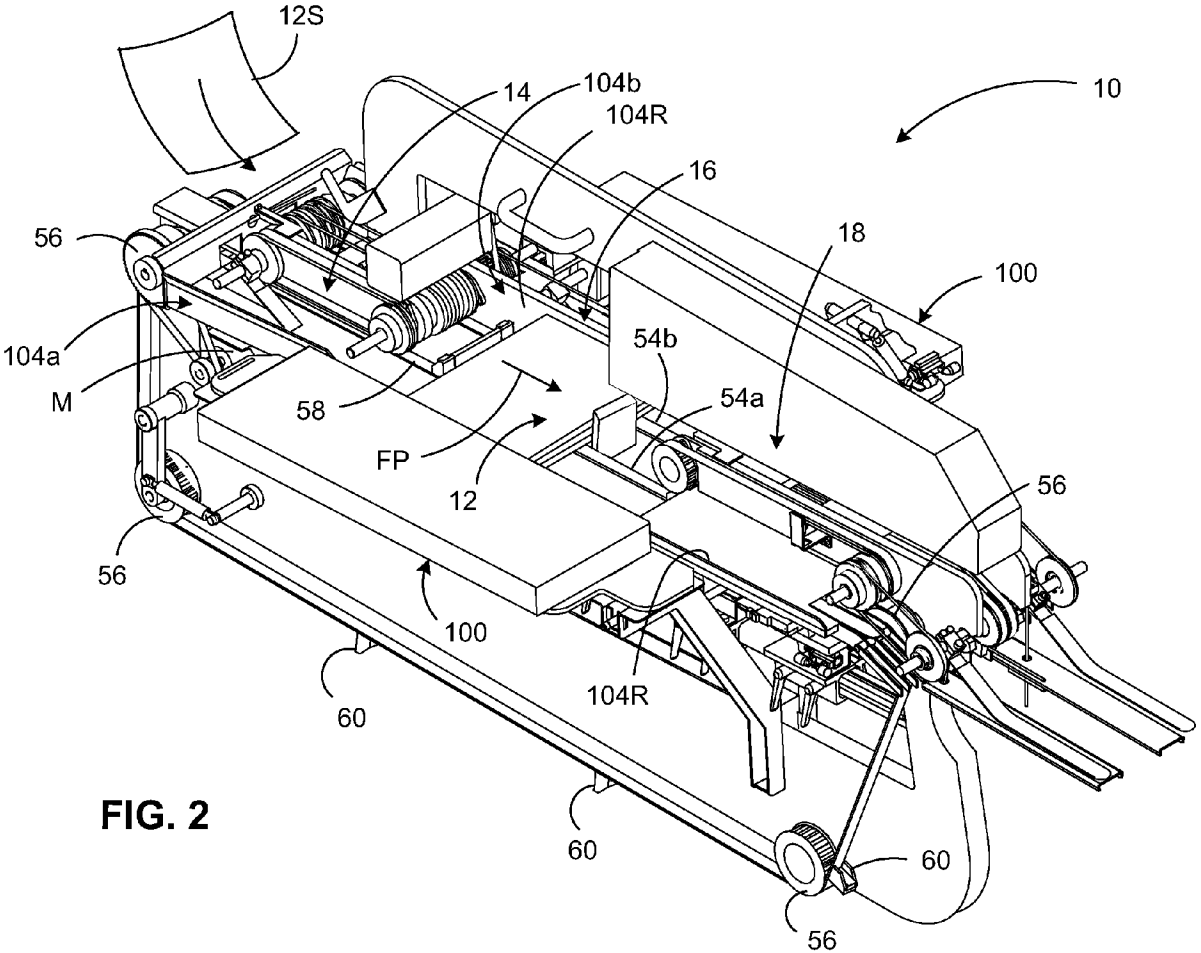
FIG. 2 is an isometric view of a stitcher/stapler module having a transport and alignment system including a pair of belts having pusher fingers to convey a multi-sheet collation along a feed path, and a system of alignment mechanisms disposed alongside and between the fingers to jog and align the edges of the collation.
Figure 3:
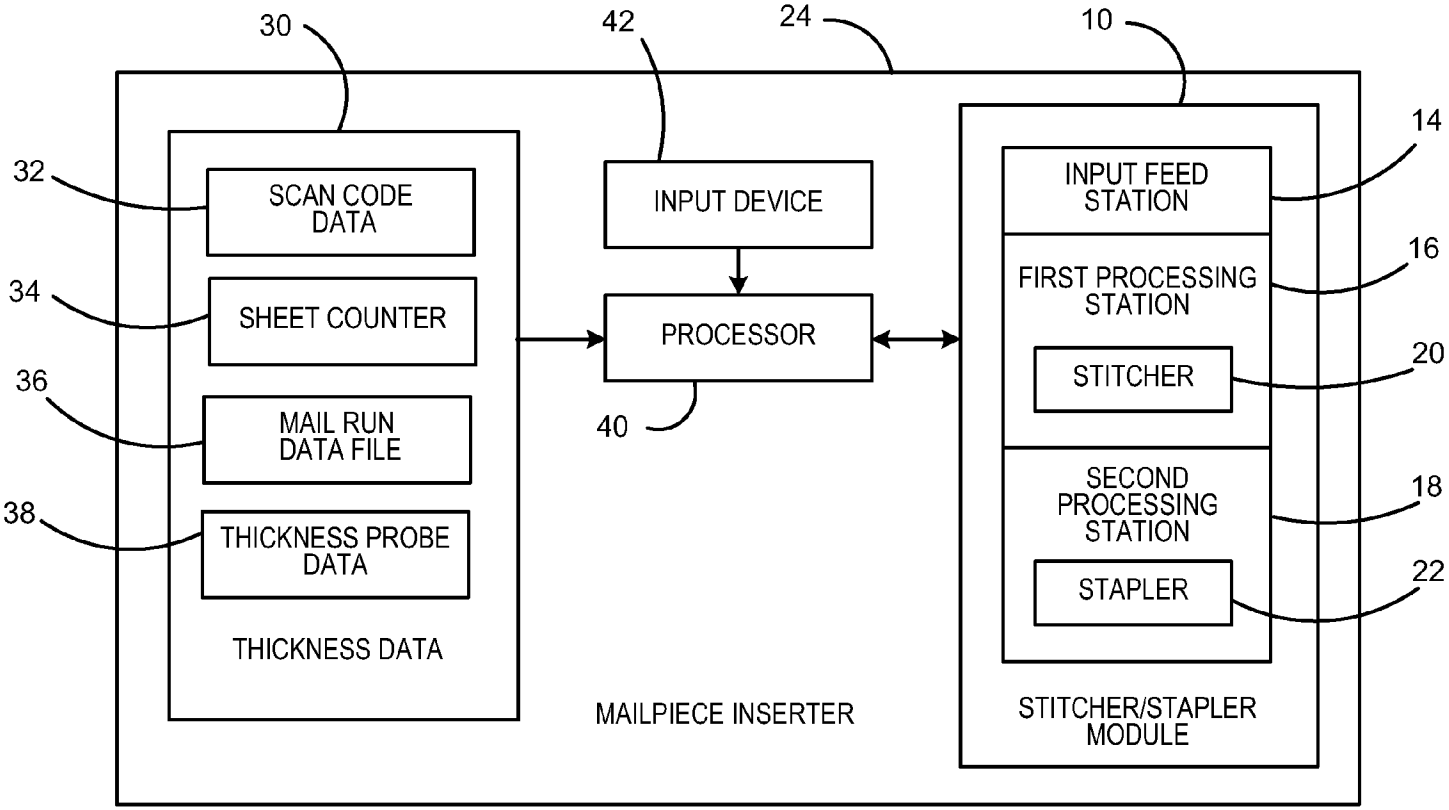
FIG. 3 is a block diagram of various components of a mailpiece inserter system including a processor for controlling the operation of a stitcher/stapler module and processing thickness data/sheet count information derived from one of a variety of sources.

In FIGS. 2 and 3, a stitcher/stapler 10 is adapted to stack, transport, align and bind consecutive multi-sheet collations 12 which vary in thickness. That is, the stitcher/stapler 10 is adapted to process consecutive collations which comprise as few as two (2) sheets to as many as one-hundred and fifty (150) sheets. It should be appreciated, however, that total number of sheets in a particular collation will generally be governed by the ability of a processing station to bind sheet material.

In the described embodiment, the stitcher/stapler 10 includes three serially-arranged processing stations including an feed input station 14, a first processing station 16, and a second processing station 18 The stitcher/stapler 10 receives sheet material 12S from an upstream sheet feeding module (discussed in greater detail herein after in the section entitled "System and Method for Fabricating Multi-sheet Collations" and accumulates/stacks of sheet material at the feed input station 14. The thickness of the multi-sheet collation 12 is determined to ascertain which of the subsequent processing stations 16, 18 will be most effective to bind the multi-sheet collation 12. The first processing station 16, immediately downstream of the feed input station 14, includes a stitcher 20 (described and illustrated in greater detail below) to bind the collation by a variable length "stitch", i.e., a length of wire which is cut/formed to produce a pair of prongs connected by a central web (similar to a staple, however, the ends of each prong are not sheared so as to form a penetrating point). The second processing station 18 includes a stapler 22 which binds the collation by a fixed length "staple", i.e., a conventional U-shaped fastener having a pair of penetrating legs connected by a central crown.

The principle difference between the two, i.e., the stitcher 20 of the first processing station 16 and the stapler 22 of the second processing station 18, relates to the capacity and/or ability of each to bind a collation. The stitcher 20 provides the capability to bind many collations before a requirement to reload a supply of stitching wire. That is, the stitcher 20 employs a relatively large spool of wire to provide a large supply of stitching material to bind multiple collations/documents. However, due to the requirement to shape each stitch from a supply of wire spool, the gauge of the wire and/or its yield strength properties, must be relatively low to facilitate the formation of the stitch, i.e., bending the wire to shape. A stapler 22, on the other hand, provides the ability to bind thick collations, e.g., a thickness greater than about forty-five thousands of an inch (0.45") or greater than about ninety (90) sheets of bond grade paper, but is limited in terms of the number of collations/documents that can be bound. With respect to the latter, the staples, which are "preformed", are fabricated from high yield strength, high stiffness materials. As a result, the legs of each staple can be fabricated to a length sufficient to penetrate thick collations without buckling. However, since the staples are preformed and packaged in strips having a finite number, only a small number of collations may be bound before the stapler 22 must be reloaded. In view of these differences, the stitcher/stapler module 10 of the present invention obtains information concerning the thickness of the multi-sheet collation such that each may be directed to the most appropriate downstream station for subsequent processing. This feature is discussed in greater detail in the subsequent paragraphs.

In FIG. 3, thickness/sheet count information 30 is used for several operations of the stitcher/stapler 10 including operations which: (i) select the processing station 16, 18 best suited to bind the collation 12, (ii) control the transport and alignment of the multi-sheet collations 12 at each of the processing stations 16, 18, and (iii) control the stitching operation at the first processing station 16 (i.e., the length of stitch, spacing between the anvil/clincher and the striker/ram, etc.) Specifically, the thickness information 30 may be obtained by (i) reading a scan code data 32 printed on the first sheet of the multi-sheet collation 12, (ii) employing a sheet counter 34 in combination with sheet thickness data input by an operator, (iii) obtaining the number of sheets directly from the job data 36 of the mail run (i.e., from the application program code which generates each sheet printed in the mail run), (iv) directly measuring the thickness via a thickness measurement probe 38, once the collation 12 has been stacked. In the described embodiment, a scanner (not shown), upstream of the stitcher/stapler module 10, reads the scan code data 32 to obtain the number of sheets contained in the collation 12. A processor 40, controlling the operation of the mail piece inserter 24 (including the stitcher/stapler module 10), determines the thickness of the collation 12 as the product of the number of individual sheets 12S multiplied by the thickness of each sheet. An operator may be prompted i.e., via a keyboard or other input device 42 to enter the type or characteristics (i.e., weight, bond, copy, etc.), of the sheet material such that the processor 40 may calculate the thickness of the collation 12 to be bound.

The processor 40 uses the thickness data/sheet count information to convey the multi-sheet collation 12 from the input feed station 14 to the stitcher 20 at the first processing station 16, or to the stapler 22 at the second processing station 18. That is, the processor 40 is responsive to a thickness value signal TS and, if the thickness of the collation is greater than (or less than) a threshold value (X), the collation 12 is transported to one of the processing stations 16, 18. In the described embodiment, if it is determined that the collation 12 is less than or equal to about forty-five thousands inches (0.45") in thickness, the collation 12 is transported to the first station 16 for processing. Therein, the collation 12 is bound by the stitcher 20 which is capable of varying the length of the stitch such that the stitch optimally extends through the collation. That is, the wire of the stitcher 20 is cut to a length such that the prongs thereof extends through the collation and the anvil of the stitcher 20 clinches the ends to an optimal length, i.e., sufficiently long to capture all of the sheets without overlapping the ends of each prong. In the described embodiment, the stitcher 20 is capable of varying the length of each stitch, i.e., from one collation to a subsequent collation. While this aspect of the invention will be discussed in greater detail below i.e., when describing the reconfigurable stitcher illustrated in FIGS. 8*a* though 8*d*, suffice it to say at this juncture, that the stitcher 20 is adapted to: (i) vary the length of the wire which forms each stitch, (ii) center the web relative to the striker/ram which drives the stitch through the collation, and (iii) vary the strike distance i.e., the distance between the striker/ram and the anvil.

If it is determined that the thickness of the collation 12 is greater than about forty-five thousands inches (0.45"), the collation 12 is transported to the second station 18 for processing. Therein, the collation 12 is bound by the stapler 22 which is capable of penetrating the thick collation without bending/buckling. That is, since each staple is fabricated from a high yield strength material, the legs of each staple are highly stabile in buckling and penetrate the collation without bending.

Transport and Alignment System for Producing Variable Thickness Collations

Figure 4:
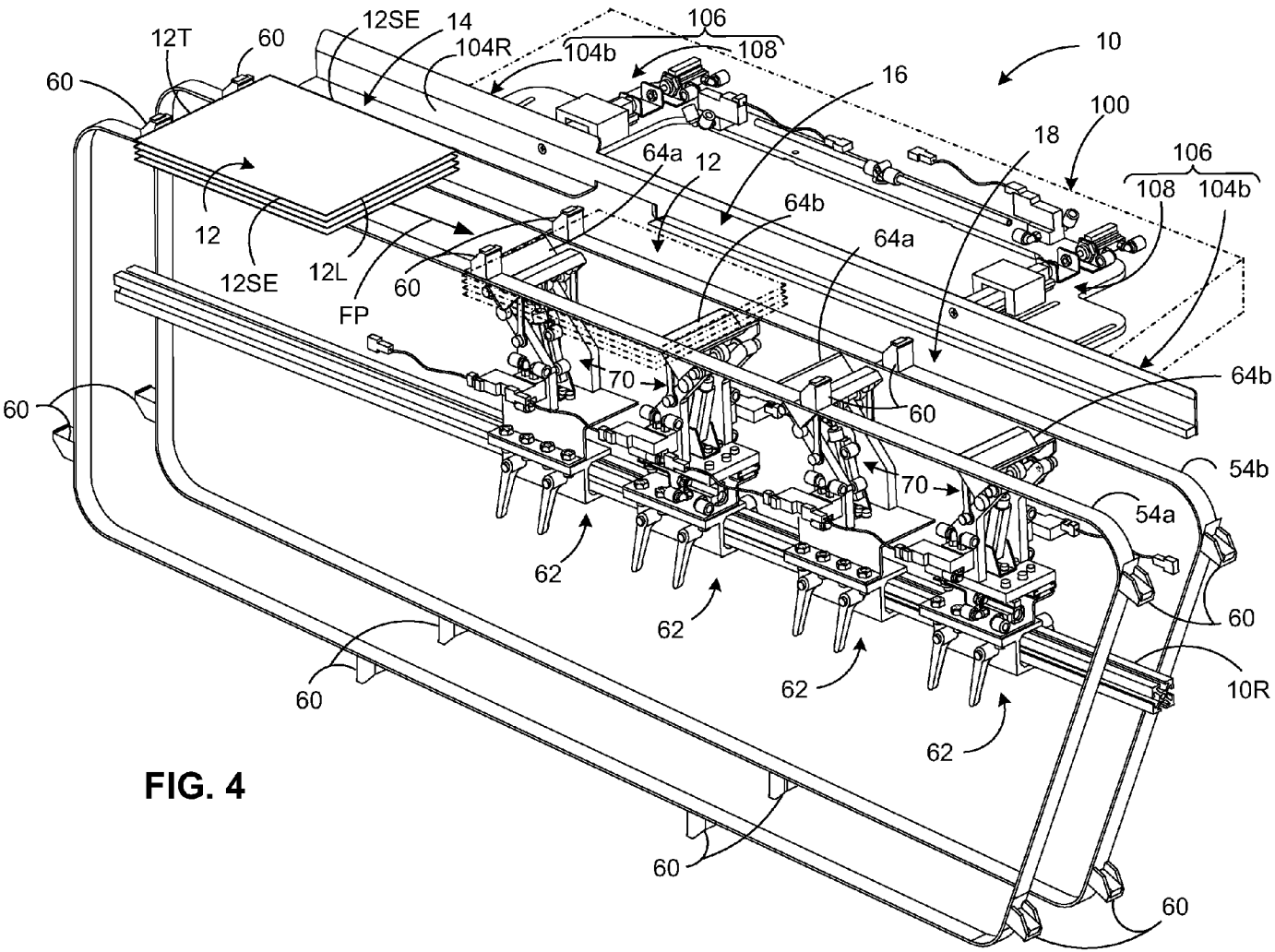
FIG. 4 is a broken away isometric view of the stitcher/stapler module of FIG. 2 to reveal the relevant details of the transport and alignment system including an feed input station for stacking a multi-sheet collation, and first and second processing stations disposed downstream of the feed input station for aligning the leading, trailing and lateral side edges of the multi-sheet collation.
Figure 5:
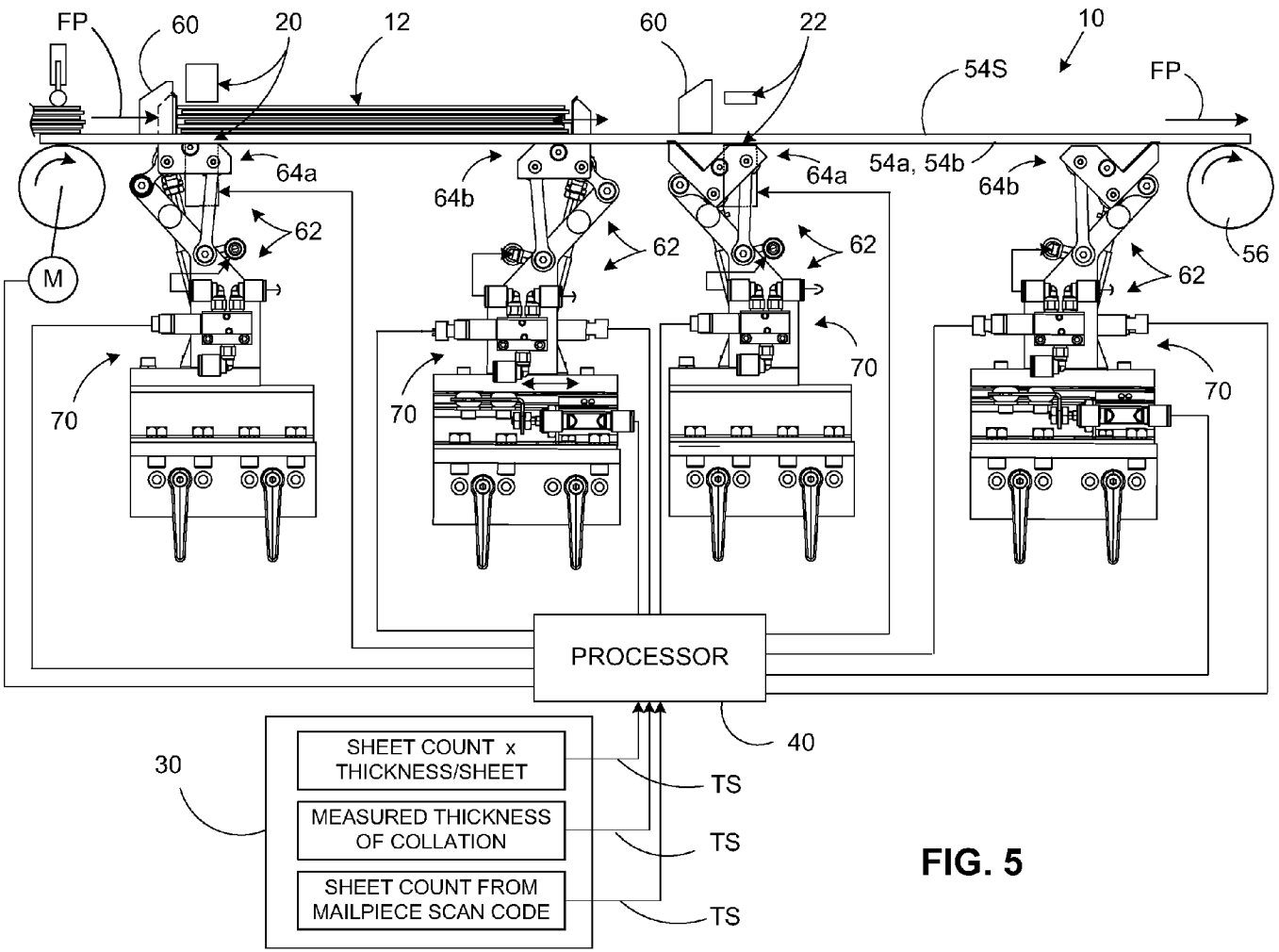
FIG. 5 is a schematic side view of the first and second processing stations each including pairs of repositionable alignment mechanisms which may be: (i) extended upward between the first and second conveyor belts to jog/align the leading and trailing edges of the multi-sheet collation, and (ii) retracted below the support surfaces of the conveyor belts to facilitate to transport along the feed path immediately prior to, and following alignment of, the multi-sheet collation.

As discussed above, the multi-sheet collation 12 is conveyed along a feed path FP of the stitcher/stapler 10 to one of the processing stations 16, 18 depending upon the collation thickness/sheet count information 30. In FIGS. 4 and 5, the transport and alignment system comprises first and second belts 54*a*, 54*b* (best seen in FIG. 4) which wrap around, and are driven by, a plurality of rolling elements 56. That is, one or more rotary drive motors M is coupled to, and drives, at least one of the rolling elements 56 associated with each of the belts 54*a*, 54*b*. In the described embodiment, the belts 54*a*, 54*b* are cogged to engage teeth disposed about the periphery of the rolling elements 56. The first and second belts 54*a*, 54*b* slideably engage, and are each supported by, a rigid support structure disposed beneath the respective belts 54*a*, 54*b* to mitigate catenation thereof between the rolling elements 56. In the described embodiment, the rigid support structures are elongate bars 58 (see FIG. 2) having a width dimension (transverse to the feed path FP of the collation 12) approximately equal to the width of each belt. As a consequence, the belts 54*a*, 54*b* and bars 58 define a space or gap therebetween to allow for binding apparatus, i.e., the stitcher 20 and stapler 22, to access the underside of the multi-sheet collation 12. Furthermore, the spacing between the first and second belts 54*a*, 54*b* mitigates skewing of the multi-sheet collation 12.

Each of the belts 54*a*, 54*b* includes a plurality of spaced-apart fingers 60 which are aligned along the conveyance/feed path FP to convey the multi-sheet collation 12 from the feed input station 14 to one of the downstream processing stations 16, 18. The fingers 60 project upwardly, i.e., orthogonally, from each of the belts 54*a*, 54*b* and engage the trailing edge 12T of the multi-sheet collation 20 at two points. Furthermore, the belts 54*a*, 54*b* are aligned across the feed path FP and driven in unison to "push" the collation 12 along the feed path FP to one of the two processing stations 16, 18.

In FIGS. 4 and 5, perspective and side views, respectively, of the belts 54*a*, 54*b* are shown to reveal opposing alignment mechanisms 62*a*, 62*b* comprising pairs of registration members 64*a*, 64*b* disposed along the feed path FP and between the first and second conveyor belts 54*a*, 54*b*. Functionally, the alignment mechanisms 62*a*, 62*b* are operative to align the opposed edges, e.g., leading and trailing edges, of the multi-sheet collation 12 as each collation comes to rest at one of the processing stations 16, 18. Once aligned, the collation 12 is bound by either the stitcher 20 or stapler 22, depending upon which processing station 16, 18 has been selected to bind the collation 12, i.e., as determined by the processor 40.

More specifically, and referring FIGS. 4, 5, and 6*a* through 7*b*, each of the registration members 64*a*, 64*b* extends transversely across the feed path FP and has a generally L-shaped cross section defined by a base 66 and a registration wall 68 disposed orthogonally from the base 66. Each registration wall 68 defines a registration surface 68R which is repositionable from an idle position (shown in dashed lines in FIG. 6*b*), below the support surface 54S (also referred to as the "transport deck") of each of the belts 54*a*, 54*b*, to an active position (shown in solid lines in FIG. 6*b*) above the support surface 54S of the belts 54*a*, 54*b*. In the idle position, the collation 12 moves over one or both of the registration members 64*a*, 64*b* and may be conveyed from the feed input station 14 to either of first or second processing stations 16, 18. Alternatively, with all of the registration members 64*a*, 64*b* in the idle position, the collation 12 may be conveyed across the entire stitcher/stapler 10 to another downstream processing station, i.e., without being bound at either the first or second processing stations 16, 18.

In the active position, at least one of the registration members 64*a*, 64*b* is adapted to oscillate forward and aft, i.e., along the feed path FP, to align the edges of the collation 12. In the described embodiment, the downstream registration member 64*b* (see FIGS. 4 and 7*b*) of each pair, i.e., the registration member 64*b* in contact with the leading edge 12L of the collation 12, oscillates forward and aft to align the sheets of the collation 12. Although, it should be appreciated that either or both of the registration members 64*a*, 64*b* may be displaced to align the collation 12.

To ensure complete and accurate registration of large collations, e.g., those having more than ninety (90) sheets or having a thickness greater than about 0.3 inches, the downstream registration member 64*b* of each pair oscillates for eight (8) cycles and is displaced a distance of about 0.25 inches with each cycle. However, to increase throughput, i.e., the number of collations processed (i.e., bound via the stitcher 20 or stapler 22), the number of cycles may be varied depending upon the thickness of the collation 12. For example, a collation 12 having as few as ten (10) sheets, or a thickness less than about 0.1 inches, the registration member 64*b* may be cycled three (3) times. Similar to the selection of the appropriate processing station 16, 18, thickness data 30, or the number of sheets in each collation 12, is used by the stitcher/stapler module 10 to determine the optimum number of cycles for aligning the sheets of each collation 12. That is, the processor 40 acquires the thickness information 30 and varies the number of cycles depending upon the collation thickness or sheet count.

To further improve throughput, the processor 40 may control the conveyance system, (i.e., the belts 54*a*, 54*b*, rolling elements 56 and drive motor M), to use the first and second processing stations 16, 18 as buffer stations. That is, when the stitcher/stapler 10 is not active, i.e., functioning only as a transport system, the processing stations 16, 18 may serve to hold/retain collations 12 (unbound collations) so that other mailpiece inserter stations e.g., folding, insertion and/or print stations (not shown) downstream of the first and second processing stations 16, 18 may process the mailpiece content material.

In FIGS. 5 through 7*b*, each of the registration members 64*a*, 64*b* pivotally mounts to a first displacement mechanism 70 operative to: (i) raise and lower the registration members 64*a*, 64*b* into and out of the idle and active positions, and (ii) oscillate at least one of the registration members 64*a*, 64*b* to align the sheets of the collation 12. In the described embodiment, the displacement mechanism 70 comprises a plurality of links 72, 74 pivotally mounting at one end to an intermediate fitting 76, and pivotally mounting at the other end to the base 66 of a respective one of the registration members 64*a*, 64*b*. The intermediate fitting 76 includes a mounting plate 78 and at least one arm 80*a* projecting upwardly therefrom. In the described embodiment, the intermediated fitting 76 includes a pair of clevis arms 80*a*, 80*b* projecting from each side of the mounting plate 78 for additional stability.

The mounting plate 78 of each intermediate fitting 76 is mounted to a center rail 10R (see FIG. 4) of the stitcher/stapler 10 by a clamp attachment 82. As such, the entire displacement mechanism 70 and respective one of the registration members 64*a*, 64*b* may be released, repositioned, and reaffixed to the rail 10R via locking cams 84. That is, to facilitate adjustment of the registration members 64*a*, 64*b*, i.e., the spacing therebetween to accommodate dimensional changes in the size of collations 12, the locking cams 84 provide an ability to quickly disconnect/reconnect the displacement mechanism 70 along the center rail 10R.

Each displacement mechanism 70 includes a first pneumatic actuator 86 which is disposed between the base 66 of the respective registration member 64*a* or 64*b*, and the mounting plate 78. In the described embodiment, the first pneumatic actuator 86 includes a linear piston/cylinder disposed between the clevis arms 80*a*, 80*b* of the intermediate fitting 76. A pneumatic valve 88 provides pressurized air $PA_1$ (see FIG. 6*b*) to the actuator 86 of respective displacement mechanism 70 to displace the registration wall 68 into and out of the idle and active positions.

Figure 6A:
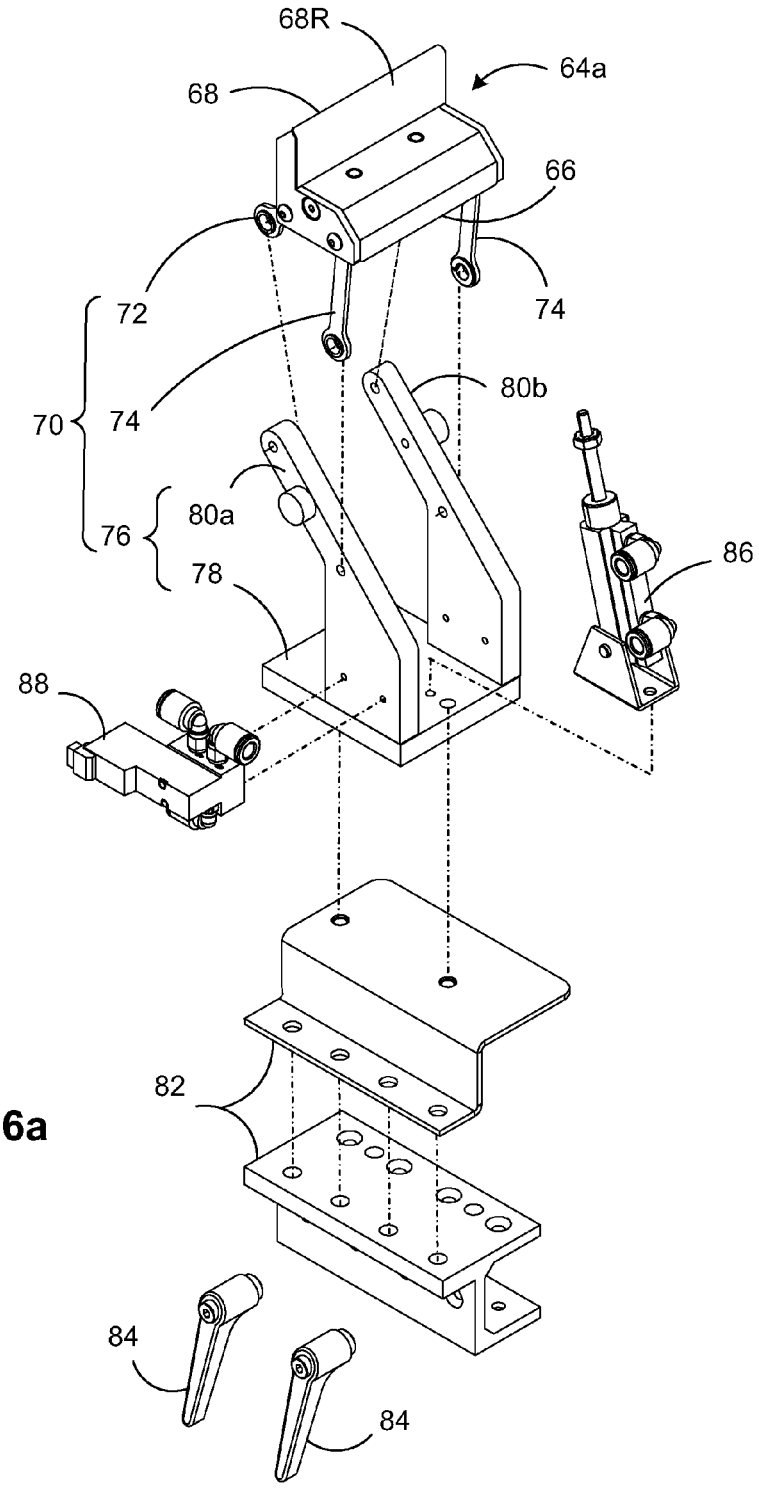
FIGS. 6*a* and 6*b* depict exploded and assembled views, respectively, of a typical trailing edge alignment mechanism including a four-bar linkage arrangement for displacing a registration member of the alignment mechanism from an idle position below the conveyor belts to an active position above the conveyor belts.
Figure 6B:
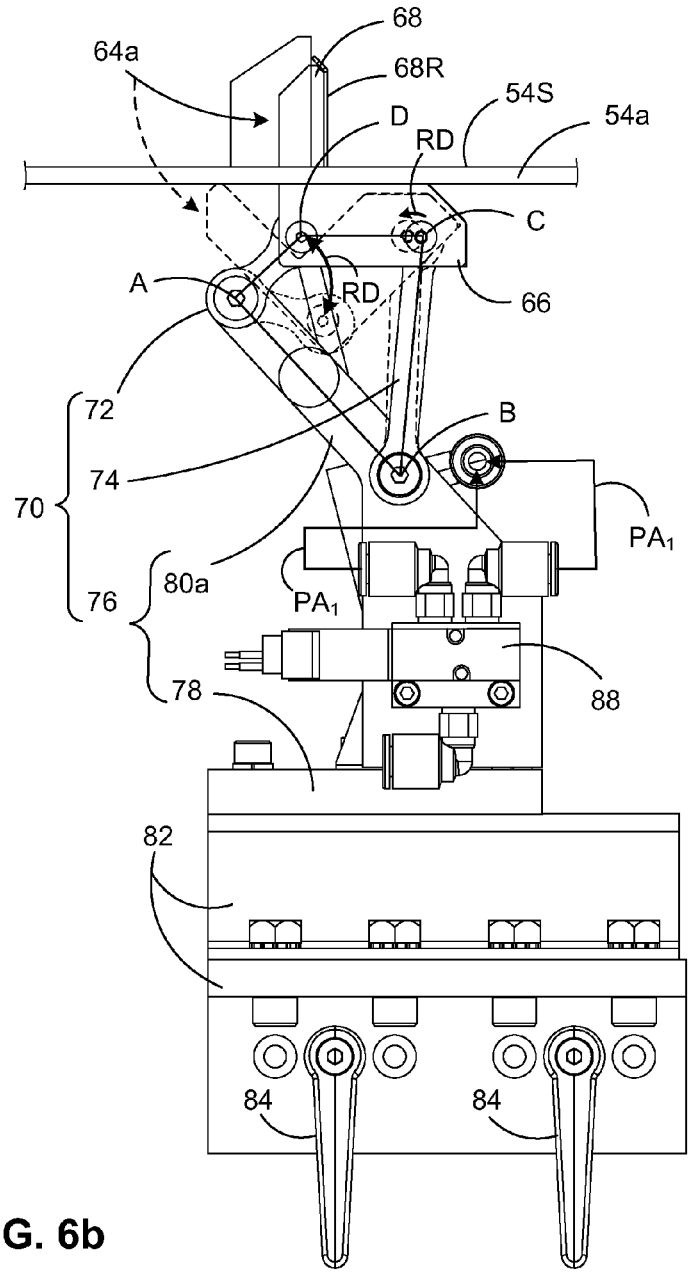

In FIG. 6*b*, an examination of the displacement mechanism 70 reveals that the links 72, 74, intermediate fitting 76, and base 66, produce a four-bar linkage defined by line segments AB, BC, CD and DA. The four-bar linkage arrangement can be configured, i.e., depending upon the length of the links 72, 74 and the location of the respective pivot points A,B,C,D, to perform the dual functions of rotation and translation of the respective one of the registration members 64*a*, 64*b*. That is, the four-bar linkage arrangement can displace the respective one of the registration members 64*a*, 64*b* to rotate above and below the surface 54S of the belts 54*a*, 54*b* while also producing a substantially linear displacement i.e., forward and aft along the feed path FP, to jog and align the edges 12L, 12E of the collation 12. With respect to the latter, such linear displacement will be accompanied by a small angular displacement, which, depending upon the geometry of the stitcher/stapler 10, may or may not be tolerated.

Figure 7A:
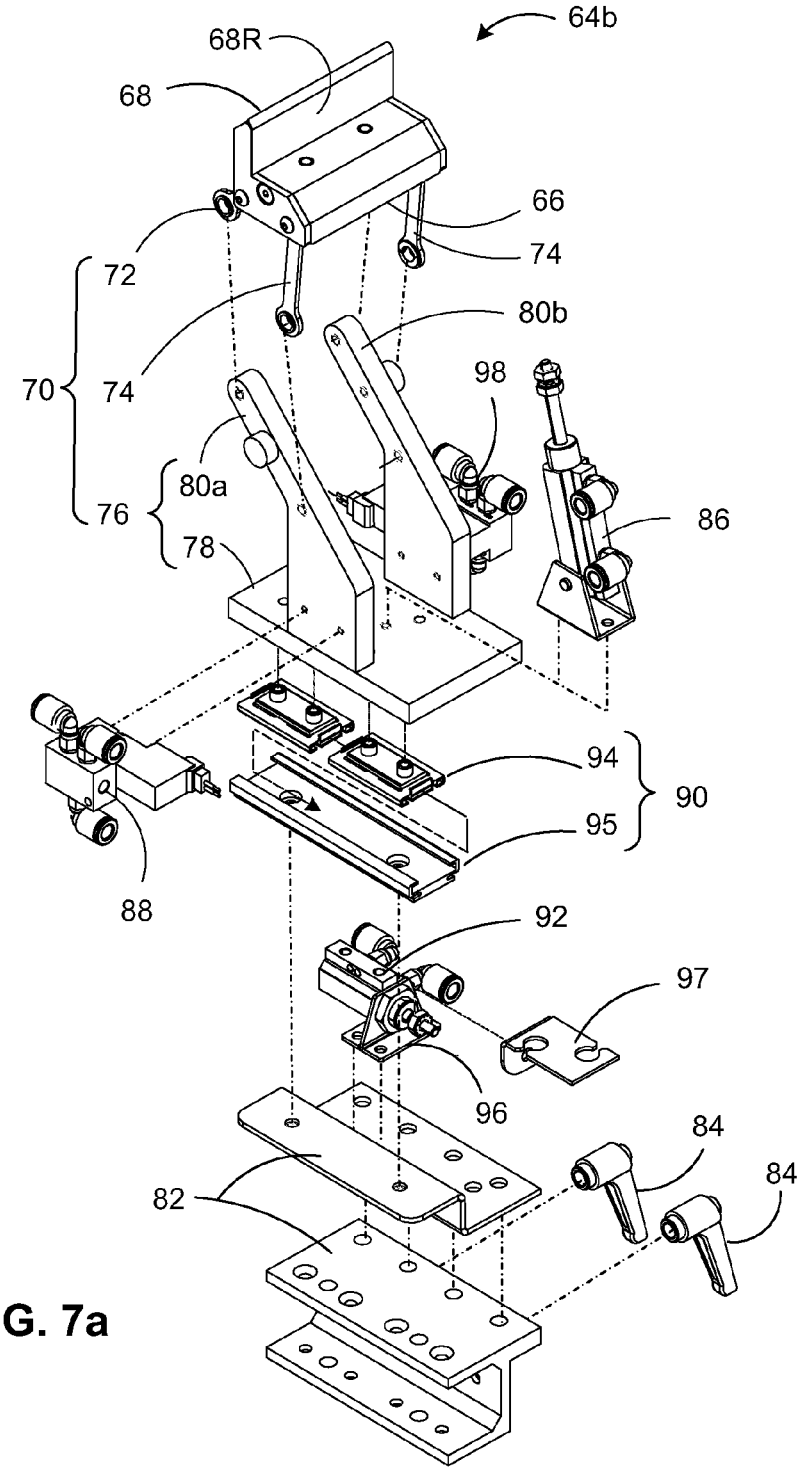
FIGS. 7*a* and 7*b* depict exploded and assembled views, respectively, of a typical leading edge alignment mechanism including a four-bar linkage arrangement for displacing the registration member from the idle to active positions, and a linear guide/actuator assembly for imparting pure linear motion to the registration member when jogging the multi-sheet collation during alignment operations.
Figure 7B:
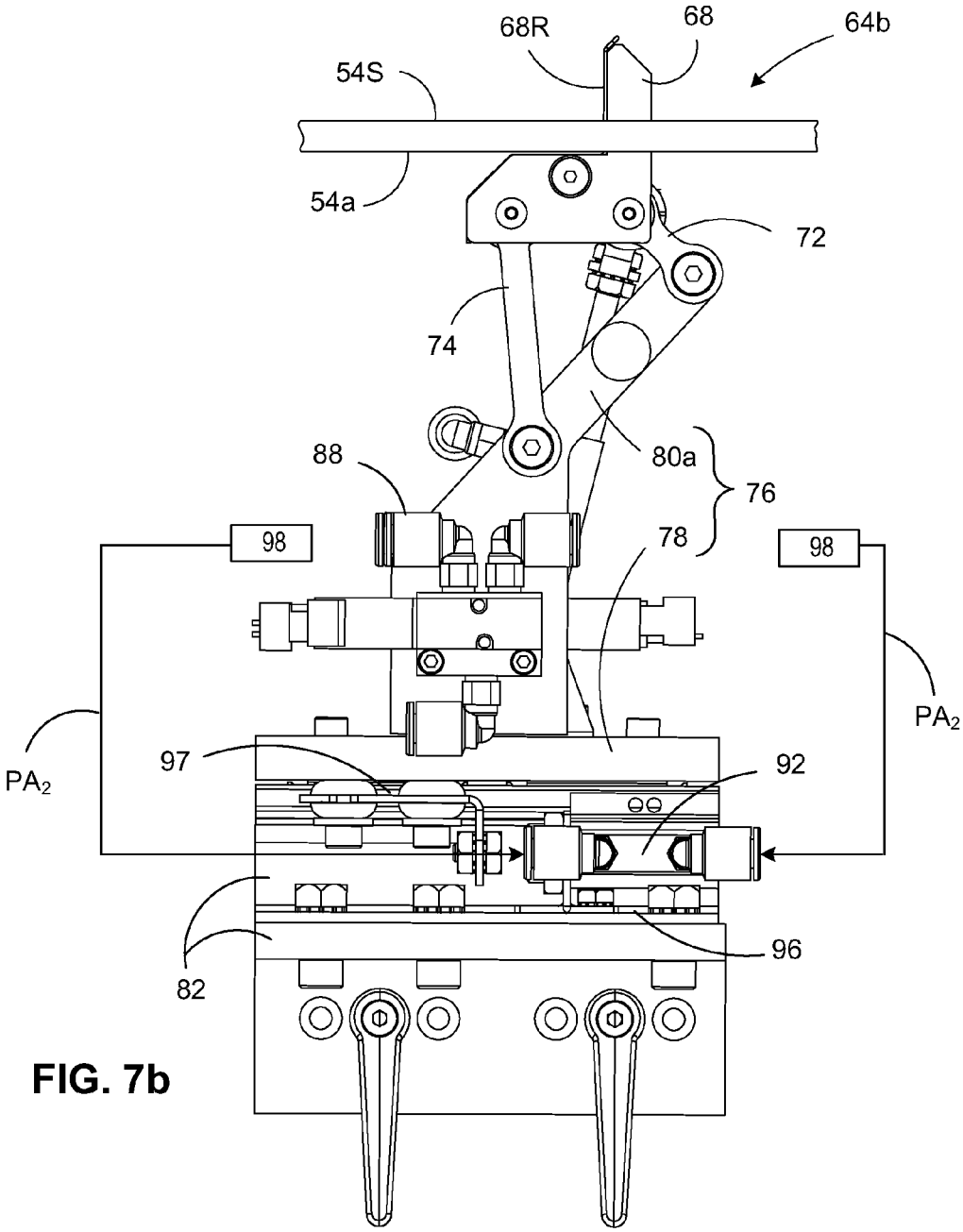

In FIGS. 7*a* and 7*b*, pure linear translation of the displacement mechanism 70 may be effected by a linear guide 90 disposed in combination with a second pneumatic actuator 92. More specifically, the linear guide 90 is disposed between the intermediate fitting 76 and the clamp attachment 82 and includes at least one sled fitting 94 affixed to the underside of the intermediate fitting 76, i.e., to the underside of the mounting plate 78, for slideably engaging a linear guide rail 95 affixed to an upper surface of the clamp attachment 82. The second pneumatic actuator 92 is attached at one end, via a flange fitting 96, to the clamp attachment 82, and at the other end, via a bracket 97, to the underside of the mounting plate 78. A pneumatic valve 98 provides pressurized air $PA_2$ (see FIG. 7*b*) to the second pneumatic actuator 92 to effect linear translation of the displacement mechanism within the linear guide 90. Recalling that only the registration members 64*b* associated with the leading edge of the collation 12 may be used to jog the collation 12, only the displacement mechanism 70 associated with downstream registration member 64*b*, associate with each processing station 16, 18 may be adapted to include the linear guide 90 and pneumatic actuator 92.

Thus far, the transport and alignment system has been described in the context of a stitcher/stapler 10 having a requirement to jog and align the leading and trailing edges of the multi-sheet collation 12. While the transport and alignment system may employ conventional alignment devices/apparatus for guiding/aligning the lateral side edges of the collation 12, e.g., rotating cams or converging side rails (not shown), the present invention employs a novel side registration system 100, seen in FIGS. 2 and 4, which spans all of the processing stations, i.e., the feed input station 14, and the first and second processing stations 16, 18. More specifically, the side registration system 100 comprises a second pair of registration members 104*a*, 104*b* each having registration surfaces 104R (only one of the registration members 104*b* is shown in FIG. 4) disposed adjacent each of the first and second conveyor belts 54*a*, 54*b*. The registration members 104*a*, 104*b* extend the length of the processing stations 14, 16, 18 and, similar to the first pair of registration members 64*a*, 64*b*, have a generally L-shaped cross sectional configuration. The spacing between the registration members 104*a*, 104*b*, i.e., the spacing across the feed path FP, may be adjusted to accommodate collations 12 which may vary in width dimension. Inasmuch as these registration members 104*a*, 104*b* do not cross the feed path, there is no requirement to raise or lower each relative to the surface 54S of the conveyor belts 54*a*, 54*b*. On the other hand, similar to the first pair of registration members 64*a*, 64*b*, at least one of the second pair of registration members 104*a*, 104*b* is adapted to oscillate in a transverse direction, i.e., toward and away from the conveyor belts 54*a*, 54*b* to align the side edges 12SE of the multi-sheet collation 12. Although, it should be appreciated that either or both of the registration members 104*a*, 104*b* may be displaced to align the side edges 12SE of the collation 12.

In the described embodiment, a second displacement mechanism 106 is attached to each of the registration members 104*a*, 104*b* and at least one of the second displacement mechanisms 106 is operative to oscillate and jog the side edges of the multi-sheet collation 12. While the second displacement mechanism 106 and registration members 104*a*, 104*b* may function to align the side edges 12SE at any or all of the processing stations 14, 16, 18, side registration of a collation 12 will generally commence at either the first or second processing stations 16, 18 where the collation 12 will be bound, i.e., by the stitcher 20, or stapler 22. Similar to the first pair of registration members 64*a*, 64*b*, at least one of the second pair of registration members 104*a* or 104*b* is operative to cyclically or repetitively engage a lateral side edge 12SE of the collation 12. In the described embodiment, the displacement of each oscillation for aligning the side edges 12SE will be about 0.25 inches, i.e., the same as the displacement required for aligning the leading and trailing edges 12L, 12T. The other of the registration members 104*a*, or 104*b* remains essentially stationary to react the impact forces generated by the opposing one of the registration members 104*a*, 104*b*. With respect to the latter, the second displacement mechanism 106 associated therewith is principally operational to adjust the location of the respective one of the displacement mechanisms 106.

The processor 40 controls the second displacement mechanisms 106 associated with the side registration system 100, i.e., to oscillate at least one of second pair of registration members 104*a*, 104*b*, using the same thickness data 30 or sheet count information obtained for cycling the first displacement mechanism 70. That is, should the thickness data 30 or sheet count require eight (8) cycles by one or both of the first displacement mechanism 70, e.g., collations 12 having more than ninety (90) sheets, then the processor 40 will command one or both of the second displacement mechanisms 106 to cycle by an equivalent number. Similarly, should the thickness data 30 or sheet count require three (3) cycles, the processor 40 will control the second displacement mechanism 106 accordingly. The number of cycles will generally decrease from a maximum of about eight (8) cycles to a minimum of about three (3) cycles as the thickness/sheet count, of the collation 12 decreases from greater than about ninety (90) sheets to a minimum of two (2) sheets. It will be recalled that such variation in the number of cycles, i.e., as a function of the collation thickness/sheet count, serves to optimize throughput.

The second displacement mechanism 106 may use any of a variety of actuators to displace and cycle the registration members 104*a*, 104*b*. In the described embodiment, the second displacement mechanism 106 employs a pair of linear actuators 108 (see FIG. 4) disposed at each end of the respective one of the registration members 104*a*, 104*b* to ensure proper alignment of the collation 12, whether the collation 12 is processed at the first or second processing stations 16, 18.

Reconfiqurable Stitcher for Binding Consecutive Variable Thickness Collations

As previously discussed, the thickness data and sheet count information 30 is used to control the stitching operation at the first processing station 16. The thickness data/sheet count 30 may be generated by any of a variety of modules/sensor of the mailpiece inserter 24 or stitcher/stapler 10 including: (1) scan code data 32 (see FIG. 3) printed on a sheet of the mailpiece content material, e.g., the first sheet of each collation 12, (ii) a sheet counter 34 in combination with sheet thickness data input by an operator, (iii) mail run data 36, i.e., obtained directly from the application software (mail run data file) used to produce the content material, or (iv) a thickness measurement device, e.g., a thickness probe 38.

In FIGS. 8*a* through 8*d*, the stitcher 20 may be reconfigurable to vary the length of each binding stitch 120 based upon the thickness T of the multi-sheet collation 12. More specifically, the stitcher 20 comprises a stitch head 122 disposed beneath the collation 12 and a clinch head or anvil 124 disposed above the collation 12. Consequently, the stitcher 20 drives the prongs P (see FIG. 8*d*) of each binding stitch 120 upwardly through the lowermost or bottom sheet 12B while the clinch head 124 crimps the ends PE of each prong P against the top or uppermost sheet 12U of the collation 12. In the described embodiment, the stitch head 122 is disposed between the first and second conveyor belts 54*a*, 54*b*, though it will be appreciated that the stitch head may be disposed to either side of the belts 54*a*, 54*b*. Furthermore, while a single stitcher 20 is depicted, it will be appreciated that several stitchers 20 may be juxtaposed across the width, or disposed in tandem along the length, of the multi-sheet collation 12, to bind the collation 12 at several locations.

Figure 8A:
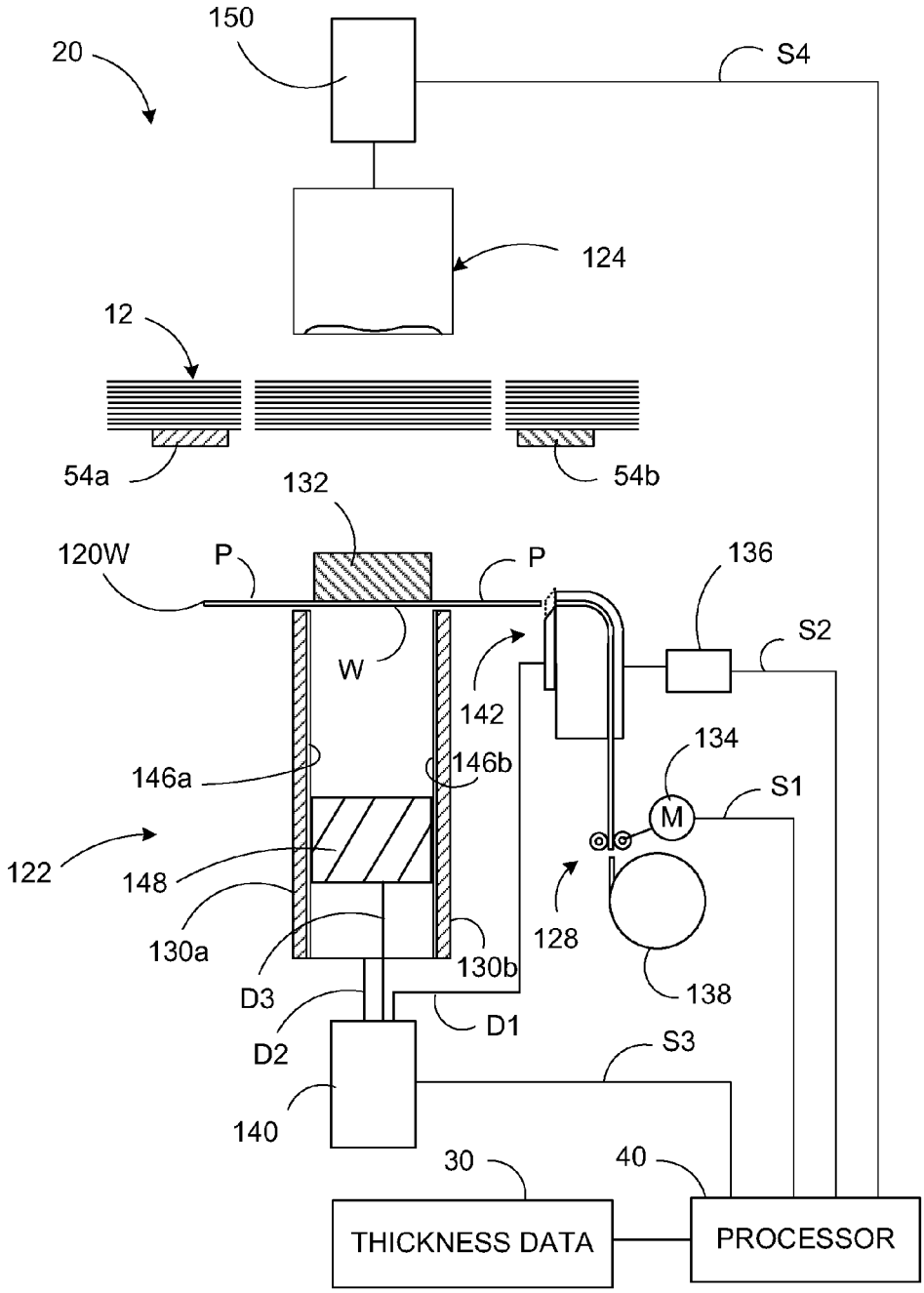
FIGS. 8*a*, 8*b*, 8*c* and 8*d* depict schematic views of a reconfigurable stitch head adapted to vary the length of each binding stitch based upon thickness/sheet count information of the multi-sheet collection.

In FIG. 8*a*, the processor 40 receives thickness data 30 in connection with each collation 12 conveyed to the first processing station. The processor 40 uses this data/information 30 to determine the length of wire 120W used to generate the respective binding stitch 120, i.e., a stitch specifically tailored in length to bind a collation 12 of a particular thickness dimension T. The processor 40 issues a first signal to a first input actuator 134, i.e., a rotary actuator, which advances wire 120W, through the nip of a pair of rollers 128, and across a pair of spaced-apart bending beams 130*a*, 130*b* of the stitch head 122. Furthermore, the wire 120 is disposed beneath a forming block 132 which cooperates with the bending beams 130*a*, 130*b* to form the prongs P about the squared edges of the forming block 132. Wire to form the stitch 120 may be drawn from a conventional spool 138 mounted to the housing of the stitcher/stapler 10. In addition to the thickness T of the collation 12, which determines the minimum length of the prongs P required to penetrate the collation 12, other dimensions needed to perform this operation include: (i) the width of the web W, i.e., the length of wire between the prongs, and (ii) the end length LE (see FIG. 8*d*) of the prong end PE i.e., the portion protruding through, and securing the collation.

The processor 40 issues a second signal S2 to a second input actuator 140 to center the wire 120W across the bending beams 130*a*, 130*b*. Additionally, the processor 40 issues a third signal S3 to a third input actuator 142 to displace several components of the stitch head 122, i.e., internal structure of the stitch head 122 which forms the stitch 120, upwardly toward the underside of the collation 12. That is, as third input actuator 142 strokes upwardly, portions of the upward displacement, denoted by lines D1, D2 and D3 actuate one or more connected elements.

Figure 8B:
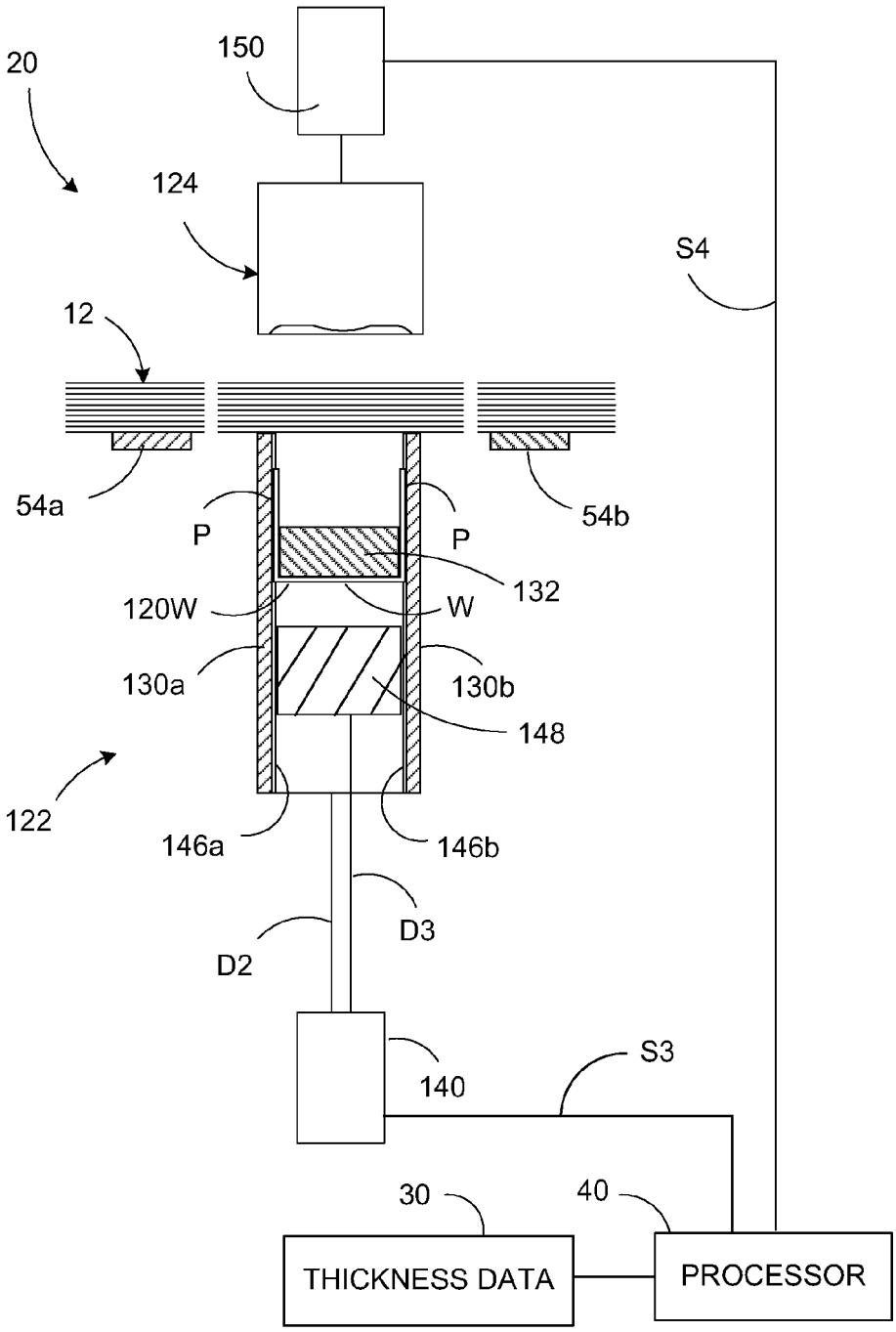

A first portion of the stroke D1 causes a shearing device 142 to cut the stitch wire 120W. This motion can be conveyed directly to the shearing device 142 or via cams connected to one of the bending beams 130*a*, 130*b*. In FIG. 8*b*, a second portion of the stroke D2 displaces the bending beams 130*a*, 130*b* upwardly. In this portion of the displacement, the stitch wire 120W falls, and is guided, within a pair of grooves 146*a*, 146*b* formed along the internal walls of the bending beams 130*a*, 103*b* to bend the stitch wire 120 about the squared ends of the forming block 132. In addition to guiding the prongs P, the internal grooves 146*a*, 146*a* provide buckling stability as the prongs P penetrate the collation 12.

Figure 8C:
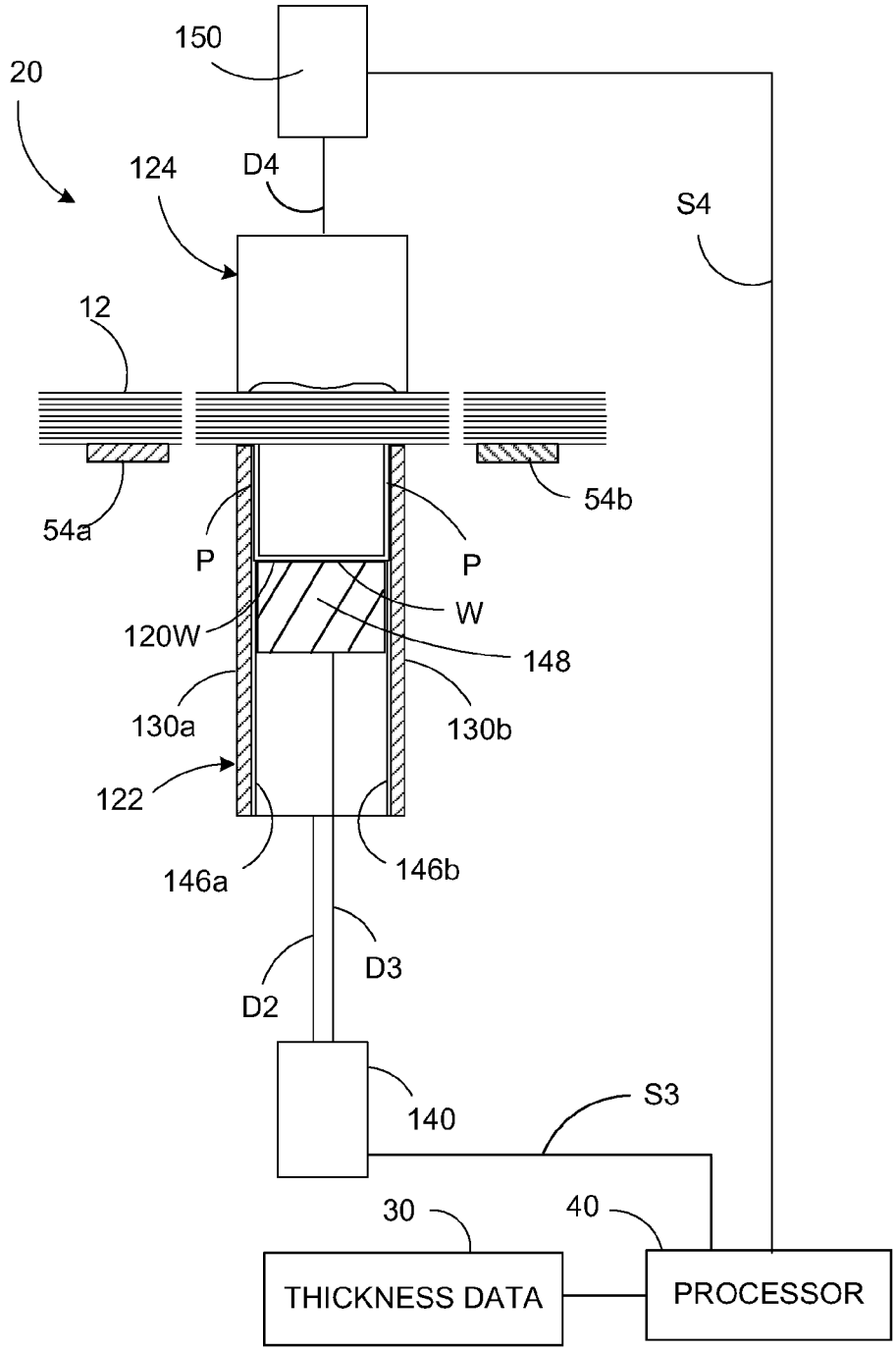

In FIGS. 8*b* and 8*c*, the displacement D2 also causes the forming block 132 (shown in FIG. 8*b*) to move away, (into or out of the plane of FIG. 8*c*) such that the web W is free to move upwardly in the subsequent portion of the stroke D3. The second portion of the stroke D2 terminates when the bending beams 130*a*, 130*b* abut the lowermost sheet of the collation 12. That is, the ends of each of the bending beams 130*a*, 130*b* define a reference surface which will be used by the processor 40 to position the anvil 124 relative to the stitch head 122. In the final or third portion of the stroke D3, a striker or ram 148 (see FIG. 8*c*) engages the web W of the stitch 120 to drive the prongs P though the collation 12. At the same time, i.e., while the lower portion of the stitcher 122 moves into position below the collation 12, the processor 40 issues a fourth signal S4 to a fourth input actuator 150 to lower the anvil or clincher 124, (a displacement denoted by line D4 in FIGS. 8*c* and 8*d*) against the uppermost sheet of the collation 12.

Figure 8D:
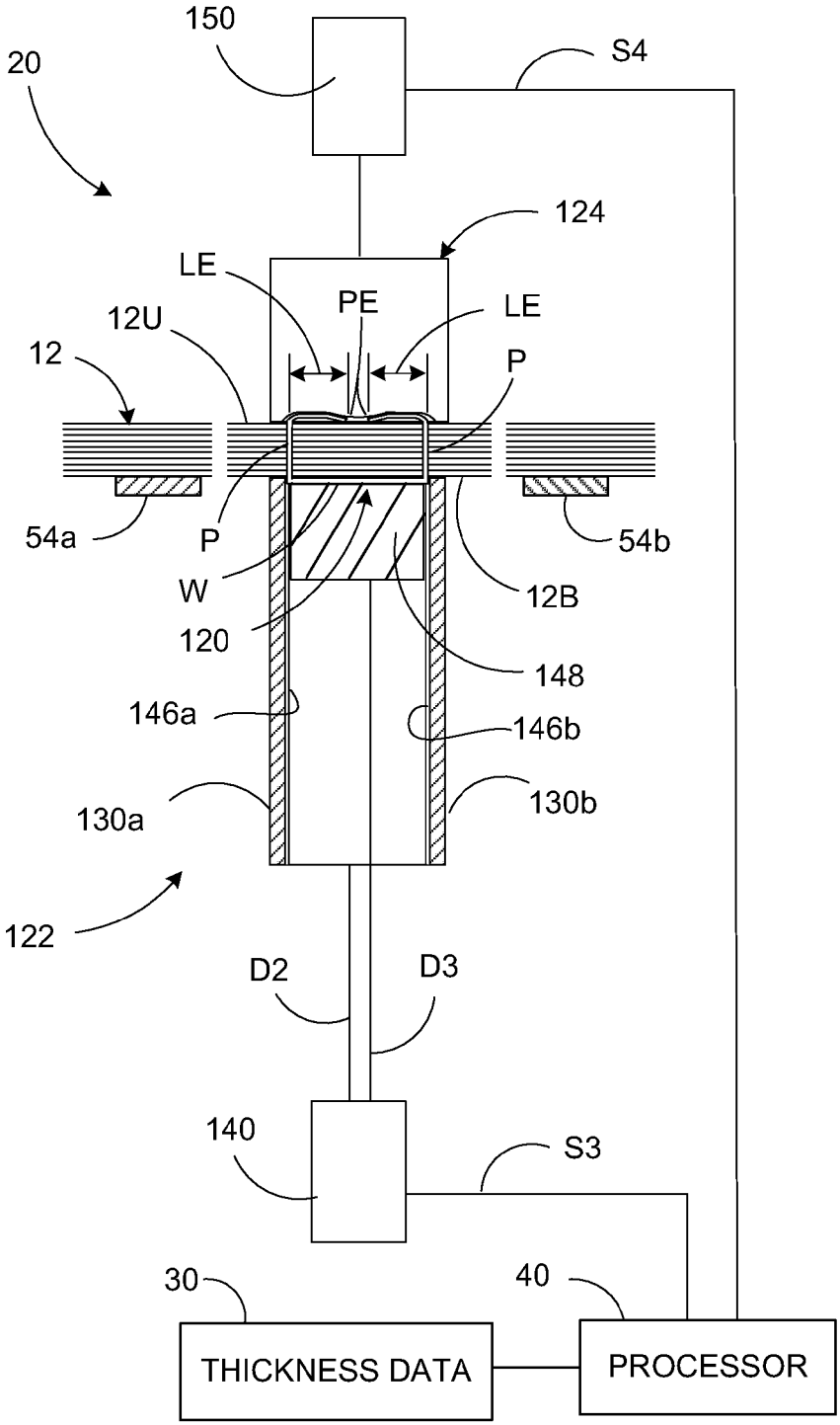

In FIG. 8*d*, the motion of the striker 148 causes the prongs P to penetrate the collation 12 and crimp/clinch the ends PE of each prong P. In the described embodiment, the clincher 150 includes arcuate surfaces for securing the ends PE of the prongs, however, other clinching devices, including those which actively recurve the ends PE of the prong P, are contemplated.

System and Method for Preparing Multi-Sheet Collations

In FIGS. 9-12*b*, a mailpiece inserter system 200 according to another embodiment of the present invention is described. The embodiment described herein relates to an inserter system 200 which obviates the misalignment of a collation edge due to folding operations. More specifically, the mailpiece inserter system 200 according to the present invention performs various processing operations, prior to folding operations, such that edge alignment is effected subsequent to folding operations. This feature, and others, will become apparent in view of the following detailed description.

While many of the mailpiece inserter devices/modules discussed in the current embodiment have the same functionality to those described hereinbefore, certain devices/modules include additional functionality. Accordingly, such devices/modules of the mailpiece inserter system 200 may be assigned a new reference identifier to reflect differences in connection with the current embodiment of the invention. Yet others, to the extent that the functionality is essentially identical to that previously described, will retain the same reference identifier.

The mailpiece inserter system 200 according to the present invention employs a feeding module or device 202 (FIG. 9) including a web or roll 202W of sheet material 202S. While the term "module" implies a device that is modular or capable of being independent and distinct from other systems, it will be appreciated that the term means any device capable of performing a particular function, whether modular or integrated with other systems. Accordingly, the terms "module", "device" or "system" are used interchangeably herein. The web 202W may include a series of pre-printed pages of content material such as bank statements, credit card invoices, marketing materials, etc., which are pre-addressed for mailpiece delivery. For example, the web 202W may include a plurality of pre-printed pages of sheet material 202S intended for delivery to a particular recipient. Each sheet of the mailpiece is printed in series, (i.e., in tandem) on the web 202W and transported by a conveyance system 204 to one of a variety of downstream processing devices/modules.

A conveyance system 204 transports the sheet material 202S to one or more downstream modules including: a scanning device 220, a cutting device 230, an accumulating device 240, a registration/binding device 250, and/or a folding device 270. The conveyance system 204 is electronically coupled to, and controlled by, a system processor 280 which controls the transport of the sheet material 202S along the feed path FP, i.e., the path taken by the sheet material as it moves from one processing device/module to another. While a single overall system processor 280 is depicted, it should be understood that multiple processors, i.e., processors associated with each of the individual processing devices/modules, may be employed and should be viewed as an equivalent for the purposes interpreting the scope of the appended claims. Furthermore, it should be appreciated that the system processor 280 controls the operation of the mailpiece inserter 200 and may acquire information from a variety of sensors/encoders to track the location, and monitor the operation being performed on the sheet material 202S.

In the described embodiment, the web 202W of sheet material 202S is transported across the scanning device 220 to acquire scan code data 32 (discussed previously in connection with the embodiment shown in FIG. 3). As mentioned previously, at least one page of a mailpiece collation 210 will include scan code data 32 printed in a margin (right or left side) of a pre-printed sheet to provide processing information about the particular mailpiece collation 210. For example, the scan code data 32 may provide information regarding: (i) the number of sheets which will be stacked to produce the collation 210, (ii) the thickness of the collation, i.e., either the total thickness or the thickness of one or more sheets, (iii) whether the collation 210 is to be bound (i.e., stitched or stapled), (iv) whether the collation 210 is to be folded and, if so, (v) the fold configuration of the collation.

The processor 280 interprets that scan code data 32 to determine the anticipated fold configuration of the collation 210. While the invention contemplates a variety of fold configurations, the invention is principally useful for preparing collations which will include a bi-fold and/or tri-fold configuration. In the described embodiment, a collation having a bi-fold configuration includes two panels folded about a fold axis. A collation having a tri-fold configuration includes a central panel and at least two outboard panels folded inwardly toward the central panel. The panels of a tri-fold configuration may be overlapping or abutting. With respect to the latter, a tri-fold configuration having panels which abut along an edge is also be referred to as a gate-fold configuration.

While, in the described embodiment, the processor 280 obtains information regarding the collation 210 using the scan code data 32 acquired from the scanner 220, the processor 280 may, alternatively, acquire information in connection with the fold configuration from the mail run data file 36 (also discussed earlier in connection with the embodiment of FIG. 3). From the fold configuration information, the processor 280 then determines a length dimension L1-L7 (see FIG. 10*a*) of each sheet of the collation 210. Before describing the operations performed by the processor 280 to interpret the fold configuration data, i.e., to determine the length dimension L1-L7 of each sheet, it will be useful to define the collation 210 in terms of an arrangement of sheets subsequent to a folding operation.

More specifically, the collation 210 comprises a plurality of sheets 211-217 (see FIG. 11) which will, subsequent to a folding operation, be folded about a fold axis FA. Generally, any collation 210 useful as an insert for mailpiece creation includes an inner sheet 211 which folds about the fold axis FA, and at least one sheet, e.g., one of the outer sheets 212-217, which fold about the fold axis FA of the inner sheet 211. For example, collations 210 having a bi-fold configuration will have a single fold axis FA (i.e., the collation shown in FIG. 11), collations having a C-fold configuration (not shown) will have only two fold axes, and collations having a Z-fold configuration will have at least two, and possibly several fold axes. Notwithstanding the fold configuration, each of the collations 210 described includes an inner sheet which folds upon itself relative to the fold axis and has outer sheets which fold about the same fold axis of the inner sheet. Furthermore, relative to one of the fold axes, the sheet which folds upon itself is the inner sheet, however, relative to another of the fold axes, the same sheet may be the outermost sheet. For example, in a Z-fold configuration, the sheet defined as the inner sheet with respect to one fold axis becomes the outer sheet with respect to an adjacent fold axis.

The processor 280 determines a length dimension L1-L7 of each sheet of the collation 210 based upon the fold configuration and issues a length signal along line LS which is indicative of the length dimension L1-L7 of each of the inner and outer sheets 211-217 of the collation 210. As mentioned in the preceding paragraph, the inner sheet 211 is defined as the sheet which folds upon itself about the fold axis FA while the outer sheets 212-217 are defined as the sheets which fold about the fold axis FA of the inner sheet 211.

In the broadest sense of the invention, the processor 280 issues a length signal along line LS in connection with each of the sheets 211-217 (see FIGS. 10*a*-11) of the collation 210 to the cutting module 230 such that the length dimension L1-L7 of at least one of the outer sheets, e.g., 212-217, is greater than the length dimension L1-L7 of the inner sheet 211. Based upon this teaching, the cutting module 230 is controlled by the processor 280 such that the length dimension L1-L7 of the inner and outer sheets 211-217 vary, i.e., from one of the sheets 211 to another of the sheets 212-217. In the preferred embodiment of the invention, the length dimension L1-L7 increases by small increments from the inner sheet 211 to the outer sheets 212-217.

The method for determining the length dimension L1-L7 of any particular sheet of the collation 210 is described in greater detail hereinafter, however, suffice to say at this juncture, that the processor 280 uses information relating to: (i) the fold configuration in combination with: the thickness dimension of each individual sheet 211-217, (ii) a summation of the sheet thickness from the inner sheet 211 to an outer sheet 217, and/or (iii) the number of sheets in the collation 210 to arrive at a collation fold solution which effects edge alignment. Moreover, the information may be obtained, derived, or calculated from any one of a combination of: (i) a thickness measurement device/probe (not shown) to measure the thickness dimension of any one sheet 211-217, or any group of sheets 211-217, (ii) input data stored in the mail run data file 36 e.g., data relating to the length of the inner sheet in combination with a median thickness dimension of the sheet material 202S dispensed from the web 202W, (iii) relationships which calculate the length dimension of any particular sheet 211-217 and/or (iv) a look-up table of the sheet length dimension L1-L7 based upon the fold configuration and type/thickness of each of the sheets 211-217.

Returning to our discussion of the mailpiece inserter system 200, the cutting module 230 receives the sheet material from the web 202W, and is responsive to the length signal LS issued by the processor 280. As mentioned above, the length dimension L1-L7 of each sheet will vary depending upon the fold configuration and thickness, i.e., number of sheets, of the collation 210. In the described embodiment, the collation 210 includes seven (7) sheets 211-217 of material. The cutting module 230 may include a rotary cutter 232 having an elongate blade 232B disposed on a rotating shaft or cylinder 232C. Therein, sheet material 202S is driven, or pulled, onto the deck of the cutting module 230 by an upstream drive roller 234R of the conveyance system 204, and paused when a sufficient length of material 202S has reached the cutting station, i.e., the portion of the cutting module 230 directly beneath the cutting blade 232B. The blade 232B is rotated into the sheet material 202S by the rotating cylinder 232C to sever the sheet material 202S to the prescribed length while a downstream roller 234R of the conveyance system 204 takes-away the individual cut sheets 211-217, i.e., along the deck of the cutting module 230. Inasmuch as the cutting module 230 is responsive to the length signal LS, the individual sheets of the collation 210 are cut such that the length dimension of at least one of the outer sheets 212-217 is greater than the inner sheet 211.

Inasmuch as the upstream drive roller 234R accelerates the sheet material 202S with each cycle, i.e., starting and stopping the sheet material 202S, the inserter 200 may include a take-up module 208 to reduce stresses induced in the web of sheet material 202S. In the illustrated embodiment, the take-up module 208 includes a vacuum plenum 208P operative to form a material loop 208L which facilitates the pay-out and accumulation of sheet material 202S within the plenum 208P. More specifically, the loop 208L allows the sheet material 202S to be rapidly paid-out when the material is pulled past the rotary cutter 232. As a consequence, stresses in the sheet material 202S, downstream of the cutting module 230, are reduced to mitigate the risk or opportunity for tearing. Moreover, additional sheet material 202S accumulates within the plenum 208P, i.e., the material loop 208L elongates therein, when the drive roller 232R is paused/stops. As a consequence, the feed module 202 may operate at constant velocity/speed, thereby avoiding the requirement to accelerate and decelerate the high inertial mass of sheet material web 202W.

Following the cutting operation, each of the sheets 211-217 is conveyed to the accumulating module 240 which is operative to stack the individual sheets 211-217 associated with a particular collation 210. In the described embodiment, the accumulating module 240 is a dual accumulator having upper and lower decks 240U, 240L which allow collations 210 to be buffered while downstream modules perform other processing operations, e.g., registration, binding and/or folding.

Once accumulated, the collation 210 is conveyed to the registration module/binding module 250 which performs the dual functions of aligning the edges of the collation 210 immediately prior to binding the collation 210. While the described embodiment integrates the alignment/registration and binding operations, it will be appreciated that each operation may be performed by separate registration and binding devices 250R, 260B. That is, a registration device 250R may be a module dedicated to registering the leading and trailing edges LE, TE of the collation 210 and a binding module 250B may be dedicated to binding the collation at one of a variety of locations, i.e., proximal to, or distal from, the anticipated fold axis FA of the collation 210.

Figure 9:
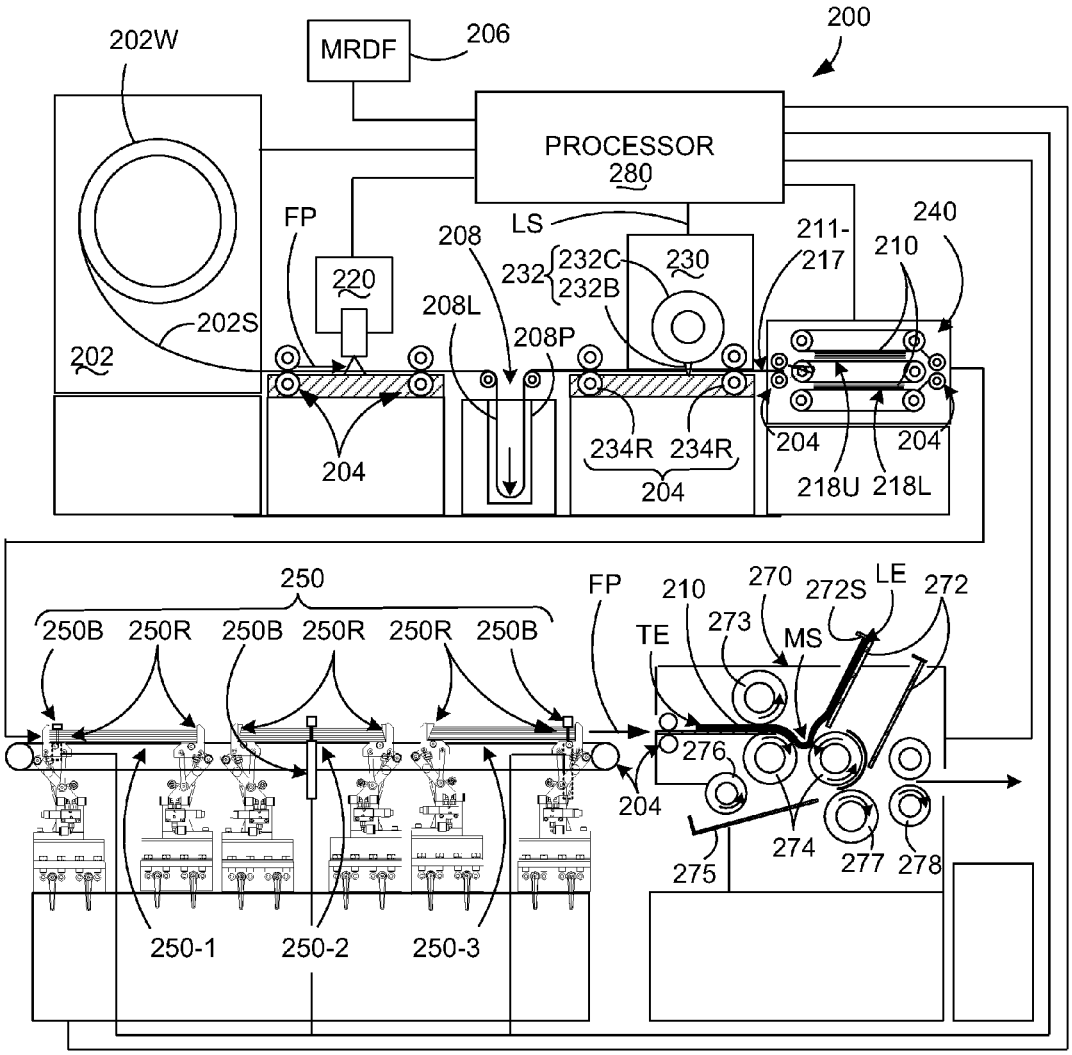
FIG. 9 depicts a schematic diagram of a mailpiece inserter according to an embodiment of the invention including a feed module, a cutting module, and a registration/binding module for producing a folded collation having vertically aligned edges.
Figure 10A:
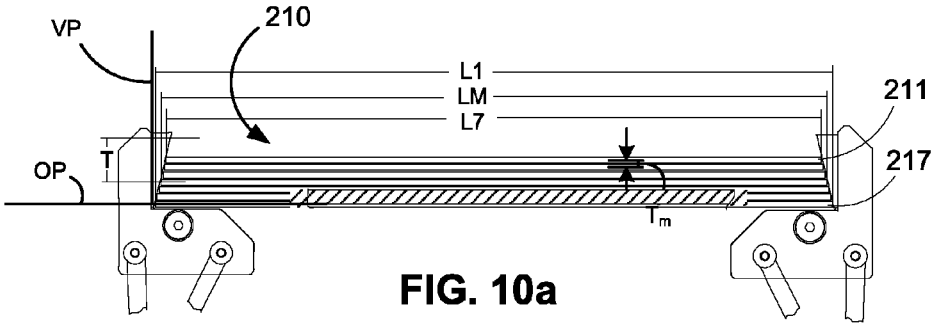
FIG. 10*a* is a broken-away side view of a registration/binding module wherein registration members define inclined surfaces to misalign the edges during registration/binding operations such that the edges are aligned following a folding operation.
Figure 10B:
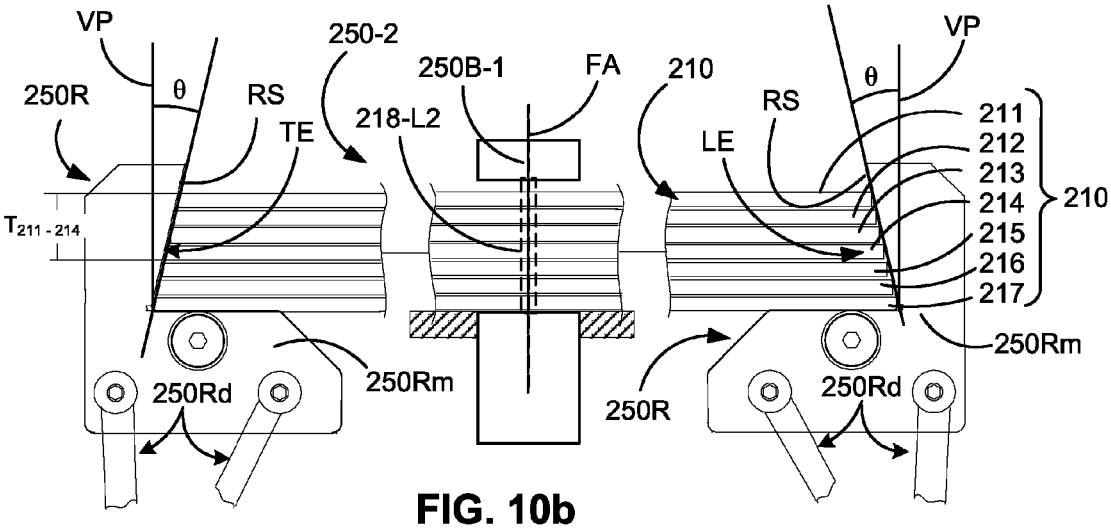
FIG. 10*b* is an enlarged side view of the registration/binding module of FIG. 10*a* having a central stitcher to bind the collation at centerline location and forward/aft registration members adapted to prepare the collation for folding about the centerline.
Figure 10C:
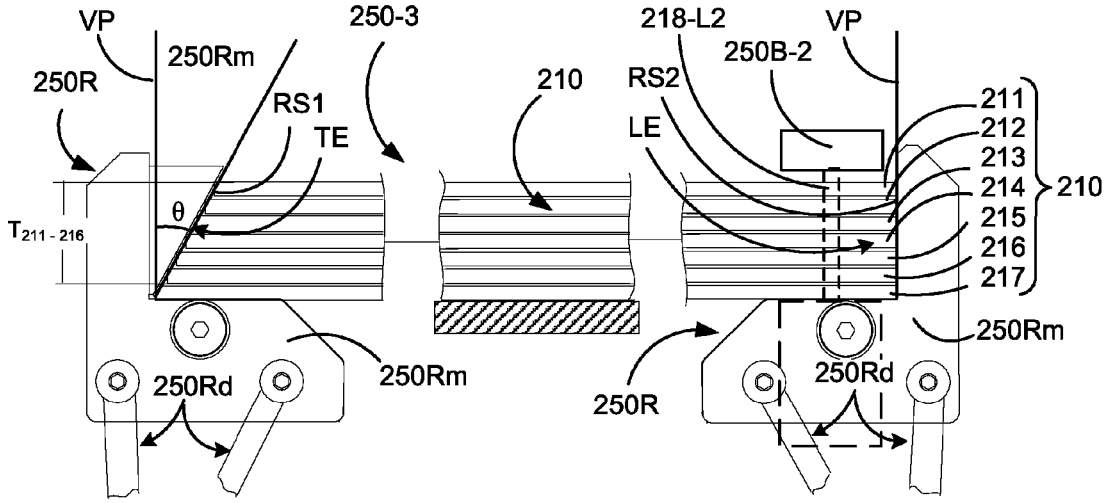
FIG. 10*c* is an enlarged side view of the registration/binding module of FIG. 10*a* having an edge stitcher to bind the collation proximal to a leading edge, and forward/aft registration members adapted to prepare the collation for folding about one or more fold axes.

In the described embodiment, and referring specifically to FIGS. 9, 10*b*-11, the registration/binding module 250 includes a registration device 250R operative to engage the edges of the collation 210 such that at least one of the edges LE, TE thereof is misaligned, or defines an angle 8, relative to a vertical plane VP (as shown in FIGS. 10*b* and 10*c*) prior to a folding operation. More specifically, the registration/binding module 250 includes at least one registration device 250R (see FIG. 9) wherein the collation 210 is disposed between opposed pairs of registration members 250Rm (FIGS. 10*b*, 10*c*). These registration members 250Rm are similar to those discussed in connection with the alignment mechanisms 62*a*, 62*b* in the preceding section entitled "Transport and Alignment System For Producing Variable Thickness Collations". Similarly, each of the registration members 250Rm is supported by and connected to a displacement mechanism 250Rd operative to oscillate the registration members into and out of engagement with the edges for alignment thereof. Further, the displacement mechanism 250Rd operates to register the edges of thin and thick collations using the same algorithms and logic as discussed earlier in connection with the alignment mechanisms 62*a*, 62*b*. Inasmuch as the displacement mechanism 250Rd is essentially identical to the first displacement mechanism 70 described hereinbefore, no further description will be provided herein.

While the registration members 250Rm may be moved from the idle to active positions in the same manner as discussed earlier in connection with the alignment mechanisms 62*a*, 62*b*, at least one the registration members 250Rm may include an inclined registration surface RS1 (See FIG. 10*b*) to effectively misalign one of the leading and trailing edges LE TE of the collation 210. In the context used herein, the term "misalign" means that the resulting edge geometry, i.e., of either the leading of trailing edges LE, TE of the collation, is disposed at an angle 8 relative to a vertical plane VP. As another point of reference, the vertical plane VP is orthogonal to another plane OP (see FIG. 10*a*) along the length and/or width of the collation 210 in an unfolded condition.

FIGS. 10*b* and 10*c* each depict a registration station adapted to receive a collation which will be folded based upon the selected/determined fold configuration. FIG. 10*b* depicts a registration device 250R adapted to prepare a collation which will be bi-folded at, or near, a centerline location, and possibly bound proximal to the fold axis. FIG. 10C depicts a registration device 250R adapted to prepare collations which will be tri-folded and possibly bound proximal to an aligned edge of the collation. The utility of such arrangement will be discussed below when discussing the subsequent folding operation. Furthermore, additional structure and functionality will be discussed in another embodiment of the invention in the section entitled "System and Apparatus for Adaptively Registering/Binding a Collation"

More specifically, in FIG. 10*b* each of the registration members 250Rm includes a registration surface RS which causes the edge geometry (i.e., the "locus of points" defined by an edge of each sheet 211-217), to slope inwardly at an angle θ from one of the outer sheets 212-217 to the inner sheet 211. It will be recalled that the inner sheet 211 is defined as the sheet which folds upon itself about a fold axis FA and the outer sheets 212-217 are defined as the sheets which fold about the fold axis FA of the inner sheet 211. As will be discussed in greater detail hereinafter, this edge geometry, (i.e., wherein both registration surfaces RS are inclined so as to cause the leading and trailing edges to be misaligned), is preferably employed when the collation 210 is to be bound, i.e., by the binding device 250B, at a location proximal to a centerline CL of the collation. In the context used herein, "proximal to the centerline" means a location between about 0.4LM to 0.6LM of the median length dimension LM (see FIG. 10*a*), as measured from an edge of the collation 210.

In FIG. 10*c*, only one of the registration members 250Rm defines a registration surface RS1 which causes an edge, i.e., the trailing edge TE, to be misaligned, or slope inwardly at an angle 8 relative to a vertical plane VP. In this embodiment, the other of the registration members 250Rm defines a registration surface RS2 which causes the opposite edge, i.e., the leading edge LE, to remain aligned, or substantially parallel to the vertical plane VP. While this too will be addressed in the subsequent discussion, this configuration (i.e., wherein only one of the registration surfaces RS1 effects an edge geometry which is misaligned), is preferably employed when the collation 210 is to be bound at a location proximal to an aligned edge of the collation 210. In the context used herein, "proximal to an aligned edge" means a location between about 0.0LM to 0.2LM from the aligned edge measured in terms of the median length LM.

Once the leading and trailing edges LE, TE of the collation 210 are registered, i.e., misaligned or aligned relative to a vertical plane VP, the collation 210 may be bound. Alternatively, the collation 210 may be conveyed directly along the feed path FP to the folding device 270, i.e., without being bound. While any suitable binding device may be employed, FIG. 10*b* depicts a stitcher 250B-1 to perform a binding operation while FIG. 10*c* depicts a stapler 250B-2 to perform the binding operation. The stitcher 250B-1 and stapler 250B-2 are structurally similar to the stitcher 20 and stapler 22, respectively, described in connection with the previous embodiment entitled "Stitcher/Stapler For Binding Multi-sheet Collation and Method of Operation" (depicted in FIG. 5 of the drawings). Accordingly, to facilitate the description, no further discussion of these binding devices 250B-1, 250B-2 are necessary at this juncture. Suffice it to say that the stitcher 250-1 may be used when the thickness of the collation 210 is less than a threshold value, while the stapler 250-2 may be used when the thickness of the collation 210 is greater than the threshold value. In the described embodiment the threshold value is about forty-five thousands inches (0.45").

While the selection of the binding device, i.e., stitcher or stapler 250B-1, 250B-2, can be important when binding thin or thick collations, of greater importance is the location of the stitch or staple relative to the fold axis FA, or relative to an edge of the collation. More specifically, when a collation 210 is to be bi-folded and bound at a centerline CL of the collation (i.e., proximal to the fold axis FA), it will be desirable to effect an edge geometry wherein both leading and trailing edges LE and TE are misaligned (i.e., wherein the angle of inclination θ slopes inwardly toward the inner sheet 211) such as the registration members 250Rm shown in FIG. 10*b*). Once again, this combination of registration and binding is required inasmuch as the binding operation prevents relative movement between the sheets 211-217 at the location of the stitch or staple 218-L1 (see FIGS. 10*b* and 11). It will be appreciated, therefore, that when binding the collation 210 proximal to the fold axis FA, it will be necessary to effect an edge geometry which is inclined, at both the leading and trailing edges LE, TE of the collation 210 such that, following a folding operation, the sheets 211-217 will slip or move relative to one another. Due to this relative movement, both the leading and trailing edges LE, TE become aligned following a folding operation.

On the other hand, when a collation 210 is to be bi-folded and bound proximal to an edge of the collation, it will be desirable to effect an edge geometry wherein only one of the leading and trailing edges LE and TE is misaligned. More specifically, when binding the collation 210 at a location proximal to a first edge, e.g. the leading edge LE, it will be desirable to effect an edge geometry wherein a second or opposite edge, e.g., the trailing edge TE, is misaligned such as the arrangement depicted in FIG. 10*c*. Further, it will also be appreciated that, inasmuch as the collation 210 is bound proximal to one edge (e.g., the leading edge LE), it will generally be desirable to effect edge alignment along this edge. That is, since the binding operation inhibits movement, or slippage between sheets, at this edge location, it will be necessary to effect edge alignment (i.e., an edge geometry which is parallel to the vertical plane VP) by the registration device, rather than on a subsequent folding operation to effect edge alignment. Of course, inasmuch as the bound edge LE is aligned by the registration member 250Rm, the opposite edge TE must be misaligned to allow for a subsequent folding operation to effect edge alignment. It will be appreciated that the angle of inclination is substantially larger, e.g., twice the degree of inclination) to effect the necessary edge alignment subsequent to a folding operation. Also, and as an aside, the rollers 204 of the conveyance system which transport the collation 210 along the feed path, are best adapted to handle a collation 210 having a leading edge LE which is aligned rather than shingled (or misaligned). As a result, it may be desirable to employ a registration/binding arrangement wherein the leading edge LE is aligned and the trailing edge is misaligned to minimize difficulties associated with conveyance.

Figure 11:
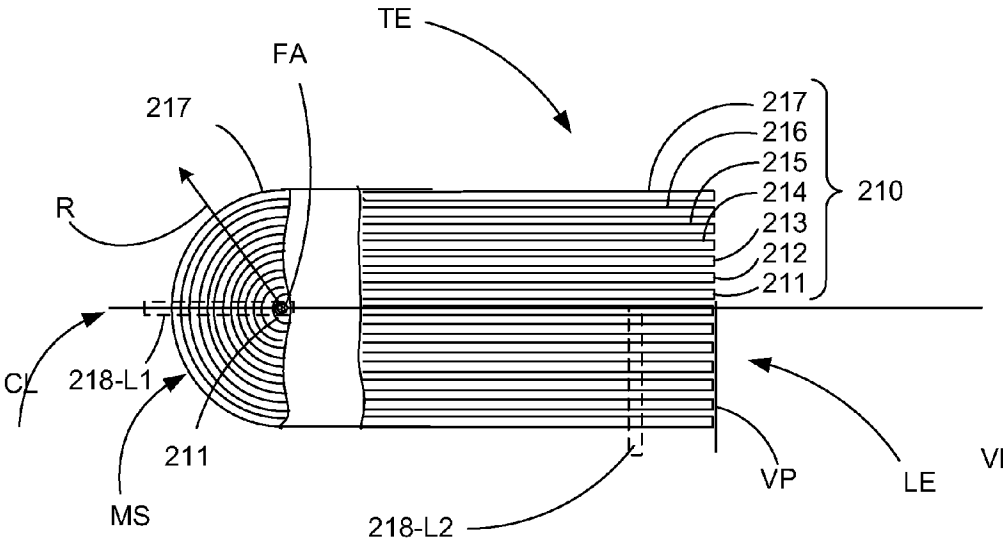
FIG. 11 is a broken-away edge view of a multi-sheet collation according to the present invention wherein the leading and trailing edges are vertically aligned, i.e., relative to a vertical plane, subsequent to the folding operation.

In FIGS. 9 and 11, once the collation 210 is registered and bound in accordance with the anticipated fold configuration, the collation 210 is folded along one or more folding axes FA by a folding device 270. In FIG. 9, the collation 270 is conveyed upwardly into at least one fold plate 272 having a stop surface 272S for engaging the leading edge of the collation 210. With the leading edge LE restrained, a roller 273 continues to drive the trailing edge TE causing the collation 210 to buckle at a midsection MS thereof. As the collation 210 continues to buckle, the midsection M is driven into the nip of folding rollers 274 such that the collation 210 is folded along the fold axis FA. Thereafter, the folded collation 210 is conveyed to a lower stop plate 275 and driven outwardly to conveyance rollers 277, 278 by an ejection roller 276.

In FIG. 11, the collation 210 has been bound and folded such that the leading and trailing edges LE, TE are aligned relative to the vertical plane VP. The collation is shown with a stitch 218-L1 disposed through the sheets 211-217 along a centerline CL or, alternatively, with a staple 218-L2 disposed through the sheets 211-217 and proximal to the edge. Inasmuch as the sheets 202S are fed from a web 202W of sheets, each of the sheets 211-217 can be cut incrementally longer or shorter depending upon the length dimension L1-L7 determined by the processor 280. When cutting pre-printed sheets from a web 202W, the incremental increase/decrease will be added to, or to taken from, the margins of each sheet. Furthermore, inasmuch as the conveyance device 204 includes numerous photo-sensors and encoders (not shown) to precisely pay-out and control the position of the sheet material 202S, a rotary cutting device 230 may be used to precisely cutting each of the sheets to a desired length dimension. Cutting devices of the type described are capable of cutting sheets to within a tolerance of about 0.004 inches, and can readily cut sheets which may vary incrementally in length dimension by as little as 0.008 inches.

Returning to our discussion concerning the operation of the processor 280 and the method of determining the length dimension, it will be recalled that the processor 280 uses information relating to: (i) the fold configuration in combination with: the thickness dimension, i.e., the median thickness dimension $T_m$ (see FIG. 10*a*) of each individual sheet 211-217, (ii) a summation of the sheet thickness from the inner sheet 211 to an outer sheet 217, and/or (iii) the number of sheets in the collation 210 to arrive at a collation fold solution which effects edge alignment. Moreover, the information may be obtained, derived, or calculated from any one of a combination of: (i) a thickness measurement device/probe (not shown) to measure the thickness dimension of any one sheet 211-217, or any group of sheets 211-217, (ii) input data stored in the mail run data file 36 e.g., data relating to the length of the inner sheet in combination with a median thickness dimension of the sheet material 202S dispensed from the web 202W, (iii) relationships which calculate the length dimension of any particular sheet 211-217 and/or (iv) a look-up table of the sheet length dimension L1-L7 based upon the fold configuration and type/thickness of each of the sheets 211-217.

This information, in combination with information concerning the thickness of each individual sheet, or the median thickness $T_m$ of the sheets 211-217, can then be used to determine a thickness dimension from an innermost sheet of the collation 210 to any outer sheet 212-217 of the collation 210 (hereinafter referred to as the "relevant thickness dimension"). With respect to the median thickness $T_m$ of an individual sheet 211-217, such thickness data can be measured using a thickness probe (not shown), or obtained from predetermined input data such as from the mail run data file 36.

In the described embodiment, the relevant thickness dimension effecting the length dimension of any particular sheet may be determined by the product of the median sheet thickness $T_m$ in combination with the number of inboard sheets of the collation, i.e., the number of sheets over which a particular sheet will fold. In addition to determining the relevant thickness dimension of the collation 210, the processor 280 identifies the anticipated fold configuration by reading the scan code data 32 from the scanner 220 which, in turn, correlates the scan code data 32 with predefined collation information in the mailpiece data run file 36 (FIG. 3). The anticipated fold configuration may include any of a variety of conventional folds such as a bi-fold, C-fold, Gate fold or Z-fold configuration. The described embodiment also contemplates the use of the scan code data 32 to determine a thickness dimension T of the collation 210, which can then be used, along with other information, to determine a length dimension L1-L7 of each sheet.

From the anticipated fold configuration and, information regarding the thickness dimension T of each sheets, or the median thickness $T_m$ of the sheets, the processor 280 determines the length dimension L1-L7 of each of the sheets 211-217 of the collation 210. Generally, the processor 280 obtains the length dimension of the innermost sheet L1 from the mail run data file, e.g., eleven (11) inches in length. From the baseline length dimension of the innermost sheet 211, the length dimension of each outer sheet 212-217, i.e., sheet outboard of the innermost sheet 211 in the direction of radial arrow R, is determined by adding an incremental length dimension required for each outer sheet 212-217 to traverse the fold axis FA of the innermost sheet 211, i.e., the sheet which folds upon itself. The incremental increase in length, from one of the sheets 212-217 to another of the sheets 212-217, allows each sheet to traverse or extend around the fold axis FA while maintaining edge alignment of each of the sheets 211-217 relative to a vertical plane VP (see FIG. 10*b*). For example, in a bi-fold configuration, the length dimension of any particular sheet L(n) outboard 212-217 of the innermost sheet 211, can be determined by the following relationships (1) and (2):

$$L(n)=L1+(\pi)(T_r) \tag{1}$$

$$T_r=(T_m)(N) \tag{2}$$

where L1 is the length dimension of the innermost sheet 211, i.e., the sheet which folds upon itself, $T_r$ is the relevant thickness dimension of the sheets inboard of the instant sheet L(n), (i.e., the sheets interposing the instant sheet L(n) and the fold axis FA of the collation, including the innermost sheet 211), $T_m$ is the median thickness dimension of each sheet, and N is the number of inboard sheets. Hence, the collective thickness dimension $T_r$ is determined by equation (2) to calculate the length dimension L(n) of equation (1).

Alternatively, for collations having C-fold and Gate-fold configurations, i.e., collations having a pair of fold axes and edges folded inwardly on the same side of a central fold panel, the length dimension of any particular sheet L(n), can be determined by the following relationships (3) and (4):

$$L(n)=L1+2(\pi)(T_r) \tag{3}$$

$$T_r=(T_m)(N) \tag{4}$$

Alternatively, for Z-fold configurations having an odd number (1, 3, 5, 7 . . . etc.) of alternating folds, i.e., folds which alternate in direction about a plurality of fold axes, the length dimension of any particular sheet L(n), can be determined by the following relationships (5) and (6):

$$L(n)=L1+(\pi)(T_r) \tag{5}$$

$$T_r=(T_m)(N) \tag{6}$$

In contrast to Z-fold configurations having an odd number of folds, those having an even number (2, 4, 6, 8 . . . etc.) of alternating folds do not require that the sheets vary in length dimension from sheet to sheet. This is principally due to the geometry of the Z-fold configuration which results in the innermost sheet associated with one of the folds to become the outer sheet of a subsequent fold. Accordingly, L(n)=L1 for Z-folded collations having an even number of folds.

From each of the foregoing relationships, (1) & (2), (3) & (4), (5) & (6), it will be appreciated that, to produce a folded collation having aligned edges (aligned relative to a vertical plane VP) at least at least one of the outer sheets 212-217 is greater in length dimension than the inner sheet 211. Furthermore, the incremental increase required to effect aligned edges, is a function of the thickness of the inboard sheets and/or, the product of the thickness of each inboard sheet in combination with the number of inboard sheets.

Table I below is a summary of the sheet length dimensions which may be suitable for preparing a seven (7) sheet collation which is bi-folded, i.e., have a bi-fold configuration such as that shown in FIG. 11. The length dimension of the innermost sheet 211 is eleven (11) inches and the median thickness $T_m$ of each sheet is approximately 0.004 inches.

TABLE I

| SHEET # | Thickness Dimension (in) | Relevant Thickness Dimension $T_r$ (in) | Length Dimension L(n) (in) |
|---|---|---|---|
| 211 (Inner) | 0.004 | 0.004 | 11.000 |
| 212 (inboard) | 0.004 | 0.008 | 11.013 |
| 213 (inboard) | 0.004 | 0.012 | 11.038 |
| 214 (inboard) | 0.004 | 0.016 | 11.050 |
| 215 (inboard) | 0.004 | 0.020 | 11.063 |
| 216 (inboard) | 0.004 | 0.024 | 11.075 |
| 217 (outer) | 0.004 | 0.028 | 11.089 |

Table II below is a summary of the sheet length dimensions which may be suitable for preparing a seven (7) sheet collation which is tri-folded, i.e., have a tri-fold configuration. The length dimension of the innermost sheet 211 is eleven (11) inches and the median thickness $T_m$ of each sheet is approximately 0.004 inches.

TABLE II

| SHEET # | Thickness Dimension (in) | Relevant Thickness Dimension $T_r$ (in) | Length Dimension L(n) (in) |
|---|---|---|---|
| 211 (Inner) | 0.004 | 0.004 | 11.000 |
| 212 (inboard) | 0.004 | 0.008 | 11.026 |
| 213 (inboard) | 0.004 | 0.012 | 11.076 |
| 214 (inboard) | 0.004 | 0.016 | 11.100 |
| 215 (inboard) | 0.004 | 0.020 | 11.126 |
| 216 (inboard) | 0.004 | 0.024 | 11.150 |
| 217 (outer) | 0.004 | 0.028 | 11.178 |

Adaptive Registration/Binding Apparatus for Preparing Collations

While the invention contemplates dedicated registration and binding modules, the described embodiment depicts an integrated registration/binding module 250 wherein the registration and binding of a collation occurs at the same station, i.e., without transporting the collation from one station to another. More specifically, the registration/binding module 250 includes multiple registration/binding stations 250R-1, 250R-2, 250R-3 adapted to provide processing flexibility in terms of fabricating a variety of folded mailpiece collations, i.e., whether the collations are thin or thick, stapled or stitched, bi-folded or tri-fold, or some combination thereof. The selection of a registration/binding station 250R-1, 250R-2, 250R-3 will be dependant upon a variety of factors including information obtained from the scan code, mail run data file, and data interpreted/processed by the system processor 280. While multiple registration/binding stations 250R-1, 250R-2, 250R-3 are depicted, it should be appreciated that a greater or lesser number of registration/binding stations may be employed which may be adaptive or reconfigurable to process multiple edge/binding configurations.

In FIG. 9, the registration stations 250R-1, 250R-2, 250R-3 may include a first station 250R-1 which registers the edges of the collation 210 in a conventional manner. That is, registration station 250-1 may include registration members which do not perform a pre-fold operation, i.e., does not misalign the edges in advance of a folding operation. A second registration station 250R-2 includes a first pair of registration surfaces RS (see FIG. 10*b*) which are adapted to register the edges of the collation based upon a desired edge geometry, e.g., an edge geometry defined by a first fold configuration such as a bi-fold configuration. A third registration station 250R-3 includes a pair of registration surfaces RS1, RS2 wherein only one of the registration members 250Rm is adapted to misalign the edge, i.e., the trailing edge TE, of the collation 210. As mentioned earlier, this configuration may be employed when the collation 210 is to be bound proximal to an edge, e.g., the leading edge LE of the collation 210. Accordingly, it will be appreciated that a variety of registration stations may be pre-configured based upon (i) the anticipated fold configuration of the collation, (ii) the thickness of the collation and/or the (iii) the desired binding location for a stitch or staple. It will also be appreciated that the thickness of the collation 210 may determine whether the collation 210 is to be stitched or stapled. This was described earlier in the section entitled "Stitcher/Stapler For Binding Multi-sheet Collation and Method of Operation."

To select/determine which of the registration stations 250R-1, 250R-2, 250R-3 will be used to register the edges TE, LE of the collation 210, the processor 280 determines the fold configuration, i.e., from either the scan code 32 or mail run data file 36 (see FIG. 3). To determine how the displacement mechanism 70 will jog the edges for alignment of the collation, the processor 280 will determine the thickness using the thickness data 30 as discussed in the embodiment described in the section entitled "Transport and Alignment System For Producing Variable Thickness Collations". To select/determine whether the collation 280 will be stitched or stapled, the processor 280 uses the thickness data 30 in combination with the fold configuration to determine where the collation will be bound. That is, if a thin collation 210 is to be bi-folded, then the registration station 250R-2 shown in FIG. 10*b* may be selected inasmuch as this station 250R-2 is integrated with a stitcher 250B-1 which is best suited for binding thin collations 210.

Having determined the processing variables, i.e., the fold configuration, edge geometry, thickness, etc., the processor 280 issues a command signal to the conveyance device 204 to transport the collation to the selected registration station 250R-1, 250R-2, 250-3. Once, registration of the collation 210 is complete, the collation 210 is bound by either a stitcher or stapler 250B-1, 250B-2. Once again, the described embodiment depicts an integrated registration/binding module 250, i.e., a module which does not require transport of the collation 210 from a registration station to a separate downstream binding station. It should be appreciated, however, that the invention contemplates both integrated and separate registration and binding stations.

Figure 13:
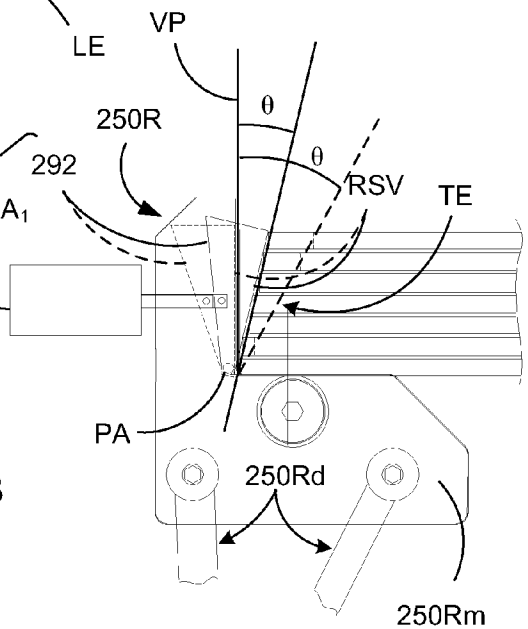
FIG. 13 is a broken-away side view of the registration/binding module including a registration element pivotably mounted to the registration member and an actuation device operative to position the registration element relative to the registration member to effect a desired collation edge geometry.
Figure 12:
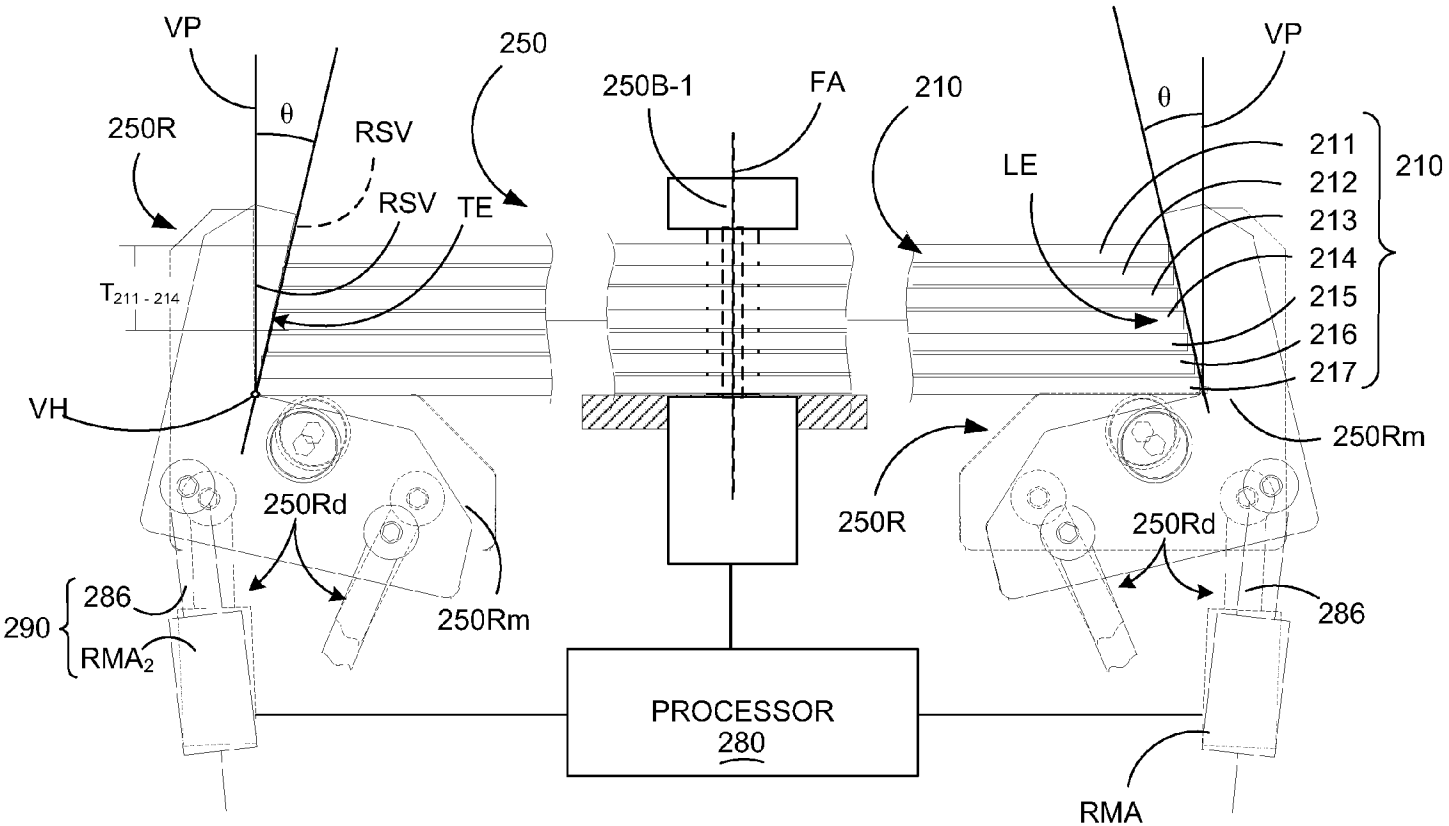
FIG. 12 is a broken-away side view of the registration/binding module wherein the registration members are displaced by a linear actuator to effect a desired collation edge geometry.
Figure 14:
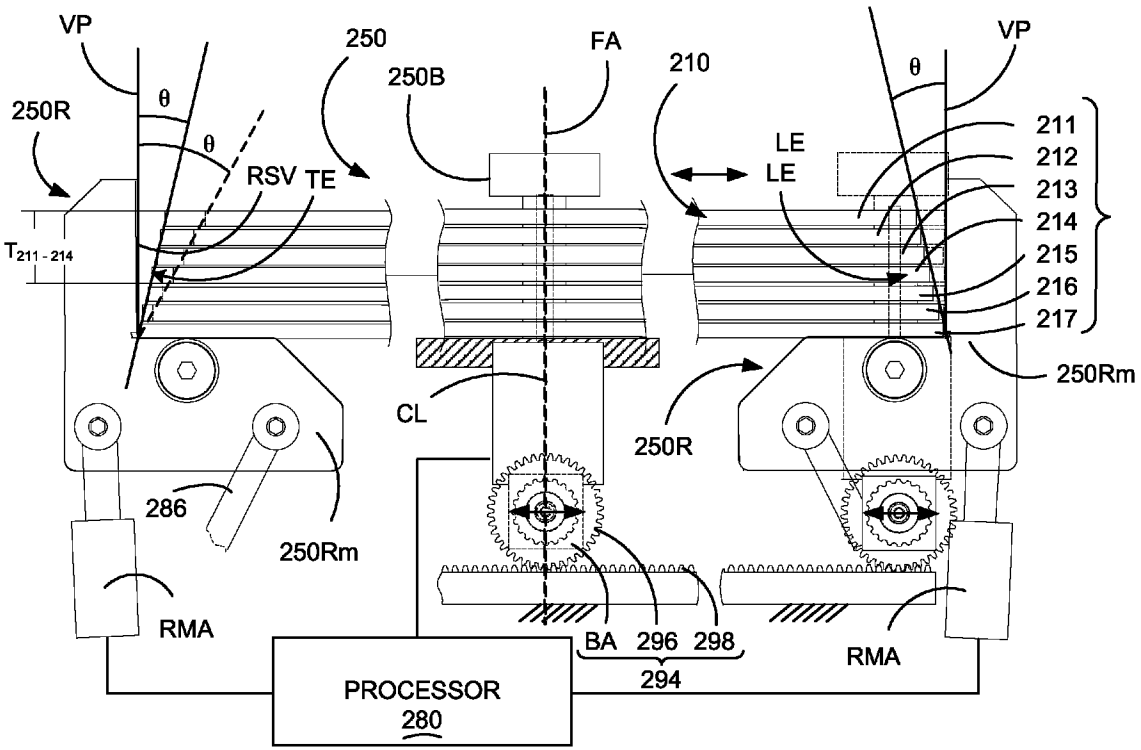
FIG. 14 is a broken-away side view of the registration/binding module including a system for displacing the binding device relative to an edge of the collation.

Inasmuch as the number of variables, i.e., the fold configuration, thickness, type of bind (stitcher/staple), and location of bind, can result in a variety of edge/binding configurations, FIGS. 12, 13 and 14 depict yet other embodiments of the adaptive registration/binding apparatus. In FIGS. 12 and 13, the adaptive registration/binding apparatus 250 includes a means 290 for variably displacing the position of the registration surfaces RSV based upon the fold configuration. More specifically, an actuation device RMS is operative to displace at least one of the registration surfaces RSV such that the angle of inclination θ is variable with respect to the vertical plane to change the edge geometry of the collation 210.

In FIG. 12, the means 290 for variably displacing the registration surfaces RSV includes a linear actuator $RMA_1$ disposed in-line with a leg 286 of the displacement mechanism 70 (see FIG. 6*d*), i.e., one of the legs 286 which comprised the four-bar linkage arrangement discussed earlier. The linear actuator $RMA_1$ is operative to increase or decrease the length of the leg 286, thereby rotating the registration surfaces RVS of the registration members 250Rm to a desired angle of inclination θ. In operation, the processor 280 determines the fold configuration to calculate the angle of inclination necessary to effect a desired edge geometry. The processor 280 issues a signal to the linear actuator $RMA_1$ to rotate the registration members 250Rm and the registration surfaces RVS about a virtual hinge VH. Upon reaching the desired angle θ, the displacement mechanism 70 jogs the registration members 250Rm to effect the desired edge geometry of the collation 210.

In FIG. 13, the means 290 for variably displacing the registration surfaces RSV includes a linear actuator $RMA_2$ disposed in combination with a registration element 292 of the registration member 250Rm. The registration element 292 is pivotally mounted to the registration member 250Rm such that extension or retraction of the actuator $RMA_2$ moves the registration surface RSV to the desired angle of inclination θ. In operation, the processor 280 determines the fold configuration to calculate the angle of inclination necessary to effect a desired edge geometry. The processor 280 issues a signal to the linear actuator $RMA_2$ to rotate the registration element 292 and the registration surfaces RVS about a pivot axis PA. Upon reaching the desired angle θ, the displacement mechanism 70 jogs the registration members 250Rm to effect the desired edge geometry of the collation 210.

In FIG. 14, a means 294 is provided to variably displace the binding device 250B such that the collation 210 may be bound at various locations along the length of the collation 210. The means 295 includes a rack of linear gear teeth 296 mounted to a fixed housing structure (not shown) of the binding device 250B, a pinion gear 298 engaging the rack of gear teeth 296, and a rotary actuator BA disposed in combination with the binding device 250B. In operation, the processor 280 determines the fold configuration to determine the desired location for binding the collation 210. For example, a bi-fold collation may be bound proximal to the fold axis FA along the centerline CL of the collation 210. Alternatively, a tri-fold collation may be bound proximal to an edge LE of the collation 210. The processor 280 issues a signal to the rotary actuator BA to drive the pinion gear 296 relative to the linear gear teeth of the rack 298. Rotation of the actuator BA drives the binding device 250B along the length of the collation 210 such that it may be bound at any desired location.

It is to be understood that the present invention is not to be considered as limited to the specific embodiments described above and shown in the accompanying drawings. The illustrations merely show the best mode presently contemplated for carrying out the invention, and which is susceptible to such changes as may be obvious to one skilled in the art. The invention is intended to cover all such variations, modifications and equivalents thereof as may be deemed to be within the scope of the claims appended hereto.

What is claimed is:

1. An apparatus for preparing a collation of sheets for a folding operation, comprising:

a registration device adapted to receive a collation of sheets;

the registration device having opposed registration members defining opposed registration surfaces operative to respectively engage leading and trailing edges of the collation such that the opposed registration surfaces each define an angle with respect to a vertical plane and respectively misalign the leading and trailing edges of the collation prior to a folding operation, and a conveyance device operative to transport the collation into and out of the registration device.

2. The apparatus according to claim 1, further comprising a displacement mechanism operative to oscillate the registration members into and out of engagement with the leading and trailing edges of the collation.

3. The apparatus according to claim 1 further comprising a means for displacing at least one of the registration surfaces such that the angle of the at least one of the registration surfaces is variable with respect to the vertical plane.

4. The apparatus according to claim 1, further comprising a means for binding the collation.

5. The apparatus according to claim 4, wherein the binding means binds the collation at a location proximal to a centerline of the collation.

6. The apparatus according to claim 1 further comprising a folder operative to fold the collation about a fold axis.

* * * * *